US007072603B2

(12) United States Patent
Tsuzuki et al.

(10) Patent No.: US 7,072,603 B2
(45) Date of Patent: Jul. 4, 2006

(54) PROCESS CARTRIDGE AND HOLDING MEMBER

(75) Inventors: Masatomo Tsuzuki, Kanagawa (JP); Susumu Nittani, Shizuoka (JP); Tatsuya Suzuki, Shizuoka (JP); Kanji Yokomori, Kanagawa (JP); Hideki Maeshima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 10/902,250

(22) Filed: Jul. 30, 2004

(65) Prior Publication Data

US 2005/0025522 A1 Feb. 3, 2005

(30) Foreign Application Priority Data

Aug. 1, 2003 (JP) ..... 2003-284839
Nov. 27, 2003 (JP) ..... 2003-397201

(51) Int. Cl.
*G03G 21/16* (2006.01)

(52) U.S. Cl. ..... 399/111; 399/114; 399/113

(58) Field of Classification Search ..... 399/113, 399/125, 111, 114, 174
See application file for complete search history.

(56) References Cited

U.S. PATENT DOCUMENTS 5,585,896 A * 12/1996 Yamazaki et al. ..... 399/174
5,638,158 A * 6/1997 Sanpe et al. ..... 399/174
5,839,028 A 11/1998 Nomura et al. ..... 399/109
5,878,309 A 3/1999 Nomura et al. ..... 399/111
5,940,657 A 8/1999 Yokomori et al. ..... 399/119
5,943,528 A 8/1999 Akutsu et al. ..... 399/110
5,950,049 A 9/1999 Yokomori et al. ..... 399/119
5,953,562 A 9/1999 Kawaguchi et al. ..... 399/117
6,029,031 A 2/2000 Yokomori et al. ..... 399/109
6,055,406 A 4/2000 Kawai et al. ..... 399/360
6,064,843 A 5/2000 Isobe et al. ..... 399/111
6,072,969 A 6/2000 Yokomori et al. ..... 399/119
6,215,969 B1 4/2001 Nomura et al. ..... 399/111
6,345,164 B1 2/2002 Yokomori et al. ..... 399/119
6,381,430 B1 4/2002 Yokomori et al. ..... 399/119
6,459,869 B1 10/2002 Nittani et al. ..... 399/111
6,463,232 B1 10/2002 Kawai et al. ..... 399/111
6,463,234 B1 10/2002 Arimitsu et al. ..... 399/113
6,480,687 B1 11/2002 Kawai et al. ..... 399/111
6,505,007 B1 1/2003 Miura et al. ..... 399/27
6,681,088 B1 1/2004 Kanno et al. ..... 399/111
6,684,041 B1 1/2004 Yokomori et al. ..... 399/167
6,703,094 B1 3/2004 Kakii et al. ..... 428/36.91
6,947,686 B1 * 9/2005 Kawai et al. ..... 399/111

(Continued)

FOREIGN PATENT DOCUMENTS

JP 02-39169 2/1990

(Continued)

*Primary Examiner*—Arthur T. Grimley
*Assistant Examiner*—Laura K. Roth
(74) *Attorney, Agent, or Firm*—Fitzpatrick, Cella, Harper & Scinto

(57) ABSTRACT

When a space holding member for holding a photosensitive drum and a developing roller in a spaced-apart state act on a process cartridge main body, the photosensitive drum and the developing roller are held in the spaced-apart state, and when the holding member is acting on a process cartridge, a storing medium provided in the process cartridge and the communication member of the storing medium are covered and hidden by the holding member. By the above-described construction, the spacing-apart of the developing roller and the protection of the storing medium can be effected by a member, and an improvement in usability and the curtailment of the number of parts can be achieved.

28 Claims, 12 Drawing Sheets

U.S. PATENT DOCUMENTS

| | | | | |
|---|---|---|---|---|
| 2002/0025185 | A1 | 2/2002 | Ito et al. | |
| 2003/0147667 | A1* | 8/2003 | Arimitsu et al. | 399/111 |
| 2003/0156848 | A1* | 8/2003 | Kawai et al. | 399/27 |
| 2003/0156855 | A1 | 8/2003 | Nittani et al. | 399/106 |
| 2003/0156856 | A1 | 8/2003 | Arimitsu et al. | 399/114 |
| 2003/0161654 | A1 | 8/2003 | Yokomori et al. | 399/111 |
| 2003/0185587 | A1 | 10/2003 | Kawai et al. | 399/111 |
| 2004/0005169 | A1 | 1/2004 | Yokomori et al. | 399/117 |

FOREIGN PATENT DOCUMENTS

| | | |
|---|---|---|
| JP | 2-110584 | 4/1990 |
| JP | 06-316349 | 11/1994 |
| JP | 2001-194866 | 7/2001 |
| JP | 2001-201914 | 7/2001 |

* cited by examiner

PROCESS CARTRIDGE AND HOLDING MEMBER

BACKGROUND OF THE INVENTION

1. Field of the Invention

The invention relates to a process cartridge for use in an electrophotographic image forming apparatus such as a copying machine or a printer adopting an electrophotographic process, and holding means, cover means and charging moving means for acting on a process cartridge main body.

The electrophotographic image forming apparatus is an apparatus for forming an image on a recording material by the use of the electrophotographic process. Examples of the electrophotographic image forming apparatus include, for example, an electrophotographic copying machine, an electrophotographic printer (e.g. a laser beam printer, an LED printer or the like), a facsimile apparatus and a word processor or the like.

Also, the process cartridge refers to charging means, developing means, cleaning means and an electrophotographic photosensitive member integrally made into a cartridge which is made detachably mountable with respect to an electrophotographic image forming apparatus main body. Or it refers to at least one of charging means, developing means and cleaning means and an electrophotographic photosensitive drum integrally made into a cartridge which is made detachably mountable with respect to an electrophotographic image forming apparatus main body. Or it refers to at least developing means and an electrophotographic photosensitive drum integrally made into a cartridge which is made detachably mountable with respect to an electrophotographic image forming apparatus main body.

2. Description of the Related Art

An image forming apparatus such as a copying machine, a laser printer or a facsimile apparatus is such that selective exposure is effected on a photosensitive drum (image bearing member) uniformly charged by a charging apparatus to thereby form an electrostatic latent image, and this electrostatic latent image is developed as a toner image by a developing apparatus with a toner caused to adhere thereto, whereafter this toner image is transferred to a recording material such as paper to thereby form an image. Then, the image bearing member after the transfer of the toner image has any toner residual on its surface removed by a cleaning apparatus, and is used for the next image forming operation.

In recent years, there are known a photosensitive drum, a charging apparatus, a developing apparatus, a cleaning apparatus, etc., made into a cartridge by being integrally incorporated as a process cartridge. This process cartridge is designed to be detachably mountable with respect to an image forming apparatus main body and therefore, a user can mount the cartridge with respect to the image forming apparatus main body, whereby the user himself can simply perform the supply of a toner and the interchange of the photosensitive drum, thus achieving the facilitation of maintenance.

Further, in recent years, there has also been devised an image forming apparatus in which a developing operation is performed with respective independent developing devices for yellow, magenta, cyan and black selectively disposed relative to a photosensitive drum, or respective developing devices are fixedly disposed relative to a photosensitive drum and are selectively driven to thereby form a multicolor image, and a process cartridge for use in such multicolor image forming apparatus has also been put into practical use.

Here, as a charging apparatus in the above-described process cartridge, a non-contact type using corona discharge or the like and a contact type using a charging roller or the like are popular, but in recent years, the latter contact type has come to be generally used with a view to preventing the generation of ozone.

However, the charging apparatus of the above-described contact type, if left in contact with the photosensitive drum for a long period, has in some cases become such that a portion of a charging member (e.g., a charging roller) which contacts with the photosensitive drum causes permanent deformation, thus resulting in a change in its charging capability, and causing a faulty image having, for example, uneven density. Also, on the surface of the photosensitive drum, the photosensitive drum and the charging member frictionally contact each other due to vibration or the like during the transportation of the process cartridge, and a hysteresis remains as a charging memory, and this has sometimes led to the occurrence of a faulty image having, for example, uneven density. Consequently, when image forming is not effected, it is preferable to mitigate the contact pressure between the charging member and the photosensitive drum. For a similar reason, when image forming is not effected, it is preferable that a developer carrying member and the photosensitive drum which contact each other when image forming is effected be separated from each other.

As means for solving the above-noted problem, there have heretofore been disclosed a method of sandwiching a spacer member in an area (non-image forming area) between the surface of a photosensitive drum and a charging member and particularly outside an area (image forming area) into which an image is written, and holding it in a state in which the two are spaced apart from each other in an unused state (particularly during conveyance) (see, for example, Japanese Patent Application Laid-Open No. H02-39169), and a method of effecting pressurization and spacing apart by the use of a solenoid (see, for example, Japanese Patent Application Laid-Open No. H06-316349). Further, a construction in which one end of a toner seal is connected to this spacer member to thereby effect the opening of the toner seal and the detachment of the spacer at a time and decrease the user's work, thereby lightening a burden (see, for example, Japanese Patent Application Laid-Open No. 2001-201914) has been disclosed. However, in the method of sandwiching the spacer member between the photosensitive drum and the charging member, the photosensitive drum, the charging member and the spacer member frictionally contact with one another even in the non-image forming area and the surface states thereof are changed, and the contacting property between the two is changed. Also, when spacing apart is to be effected by the use of a solenoid, it is necessary to newly provide a complicated circuit. Also, to effect the opening of the toner seal and the detachment of the spacer at a time, a strong force has been necessary.

Also, when an attempt is made to space not only the charging member and the photosensitive drum, but also a developer carrying member and the photosensitive drum apart from each other, there have been the problems that the number of parts becomes great and the cost becomes high and that usability becomes poor.

On the other hand, recently, a process cartridge containing a storing element therein has made an advent. There is adopted a method of exchanging information regarding the quality of image, information regarding the manufacture and life of the process cartridge, information regarding the working state of an image forming apparatus main body, etc. between the storing element and the main body to thereby facilitate the maintenance of the image forming apparatus or the process cartridge, and improve usability (for example, U.S. Patent Application Publication No. US-2002-025185-A). The storage element effects communication with the image forming apparatus and therefore, a storing element main body and an electrical contact portion which is an example of the communication means thereof are usually installed on the outermost surface of the process cartridge.

During distribution or the like, however, there may occur pressure or frictional contact exceeding a condition supposed for the storing medium. In such a case, in the distribution process or the like, it is desirable to provide a member for protecting the storing medium besides the aforedescribed spacer member, but on the other hand, there is also conceived the occurrence of a reduction in usability by an increase in the number of parts and the user's work of detaching the member, and various inconveniences resulting from forgetting to detach the member.

SUMMARY OF THE INVENTION

The present invention has been made in order to solve the above-noted problems peculiar to the prior art.

It is an object of the present invention to provide an inexpensive process cartridge simplified in construction.

It is an object of the present invention to provide an inexpensive process cartridge decreased in the number of parts.

It is an object of the present invention to provide a process cartridge improved in usability.

It is an object of the present invention to enable developer carrying means and/or charging means to be spaced apart from an image bearing member by a simple construction, and to obtain a stable image free of unevenness or transverse streaks.

DESCRIPTION OF THE PREFERRED EMBODIMENTS

First Embodiment

[General Construction of a Color Image Forming Apparatus]

Figure 2:
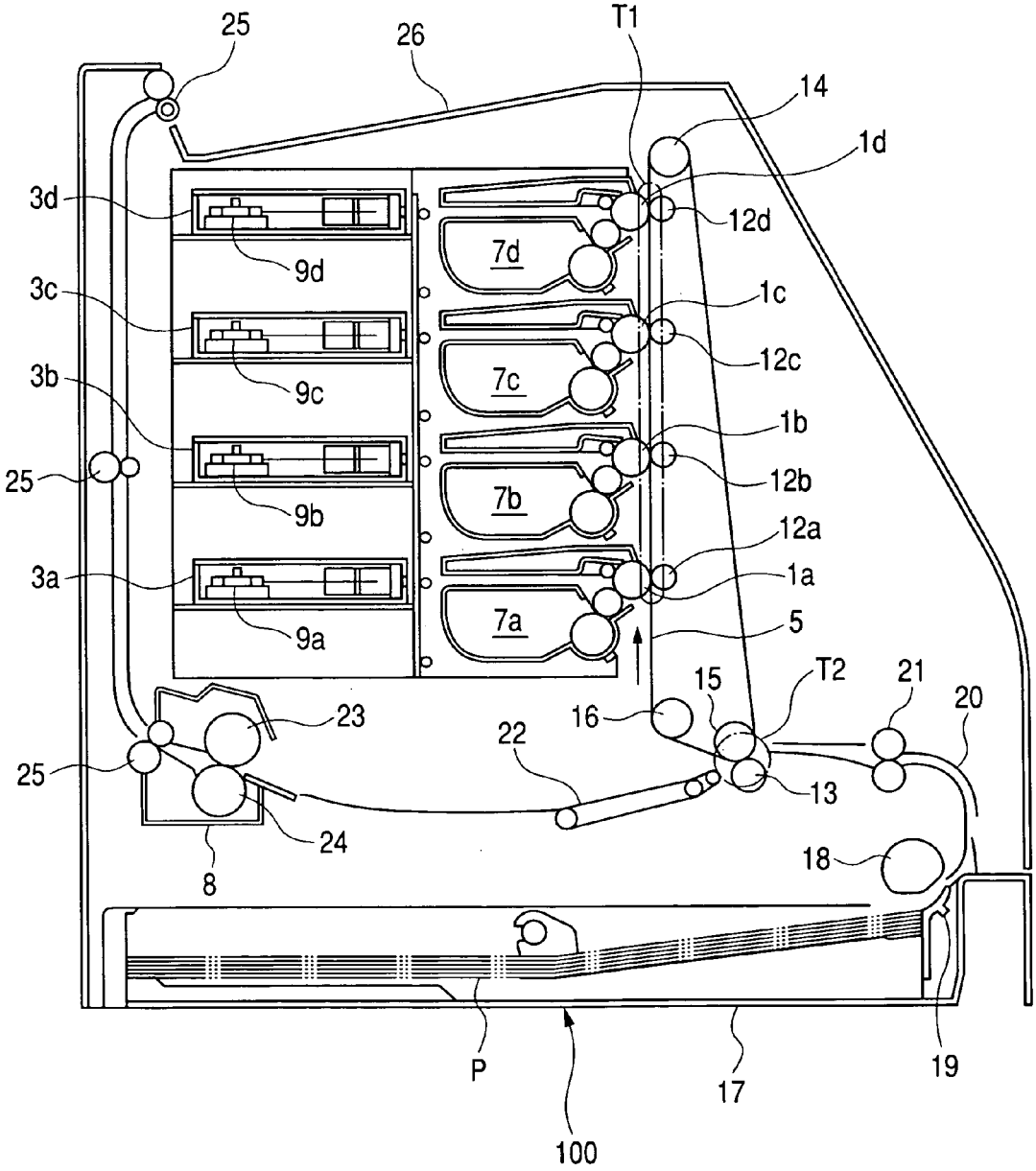
FIG. 2 is a cross-sectional view showing the general construction of a full-color electrophotographic image forming apparatus according to an embodiment of the present invention.
Figure 3:
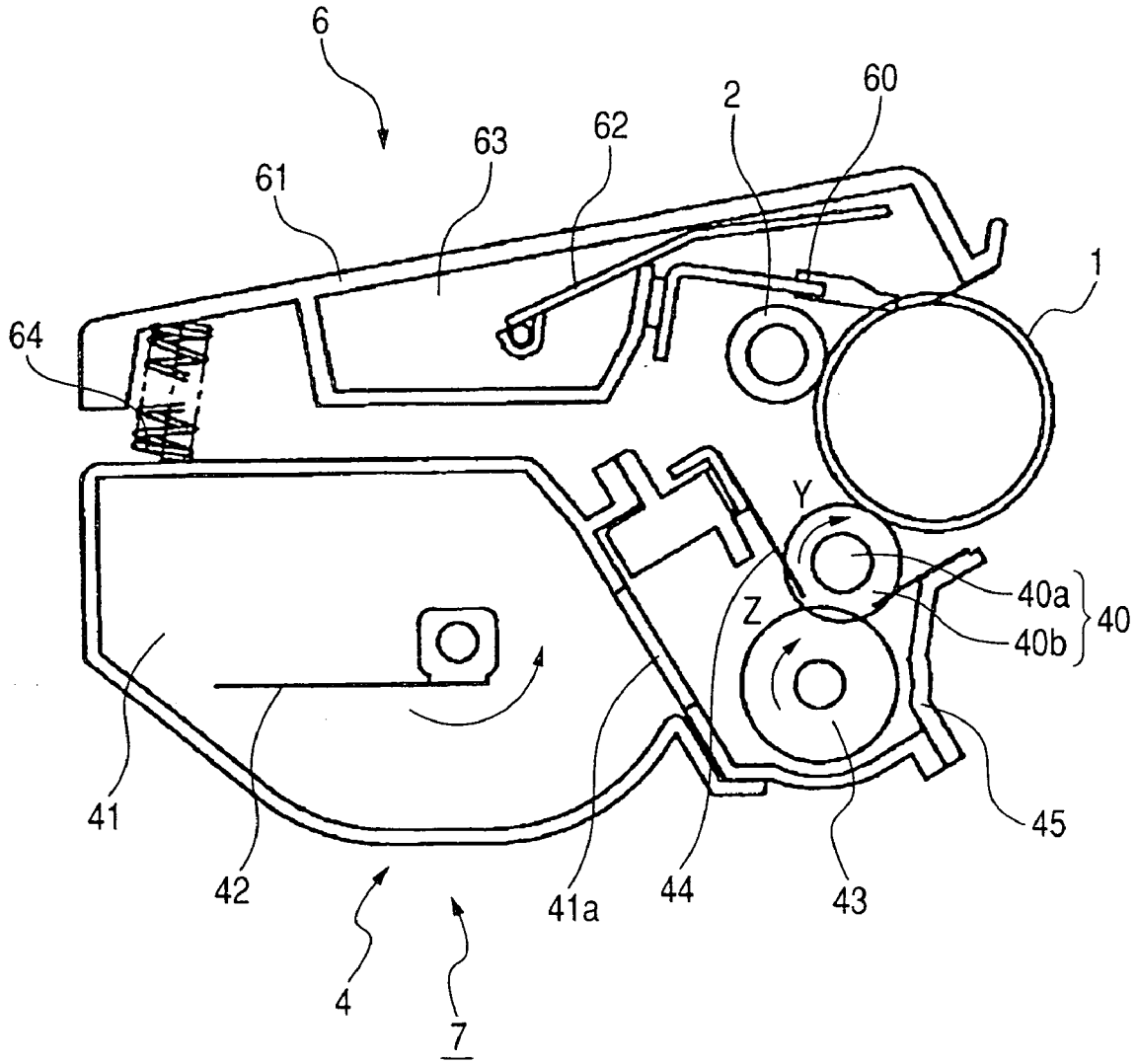
FIG. 3 is a cross-sectional view showing the general construction of a process cartridge according to an embodiment of the present invention.

The general construction of a color electrophotographic image forming apparatus which is an example of an electrophotographic image forming apparatus will first be schematically described with reference to FIGS. 2 and 3. FIG. 2 is an illustration of the general construction of a full-color laser beam printer (hereinafter referred to as the printer) which is an embodiment of the color electrophotographic image forming apparatus, and FIG. 3 is an illustration of the general construction of a process cartridge used therein.

The printer 100, as shown in FIG. 2, is provided with an image forming portion having an electrophotographic photosensitive member (hereinafter referred to as the photosensitive drum) 1 (1*a*, 1*b*, 1*c*, 1*d*) which is an example of an image bearing member for each of yellow (Y), magenta (M), cyan (C) and black (Bk), and an intermediate transfer member 5 for holding thereon color images developed by the image forming portion and transferred thereto in a multiplexed manner, and further transferring the color images to a transfer material P fed from a feeding portion.

The photosensitive drum 1 is driven to rotate counterclockwise in FIG. 2 by driving means.

Process means are disposed around the photosensitive drum 1. That is, a charging roller 2 which is an example of charging means for uniformly charging the surface of the photosensitive drum 1, a scanner unit (3*a*, 3*b*, 3*c*, 3*d*) for applying a laser beam on the basis of image information to thereby form an electrostatic latent image on the photosensitive drum 1, a developing roller 40 (which is provided in a developing unit 4) which is an example of a developer carrying member for causing a developer (hereinafter referred to as the toner) to adhere to the electrostatic latent image on the photosensitive drum 1 to thereby develop the latent image as a toner image (visible image), the intermediate transfer member 5 to which the toner image on the photosensitive drum 1 is transferred in a primary transferring portion T1, and a photosensitive drum unit having the function of a cleaning apparatus for removing any untransferred toner remaining on the surface of the photosensitive drum 1 after the transfer to the intermediate transfer member 5 are disposed in the named order in accordance with the rotational direction of the photosensitive drum.

The toner image of each color is transferred from the photosensitive drum 1 for each of Y, M, C and Bk as described above to the intermediate transfer member 5, whereby a color toner image is formed on the intermediate transfer member 5. The color toner image transferred to the intermediate transfer member 5 is further transferred to a transfer material P which is an example of a recording material by a secondary transfer roller 13 in a secondary transferring portion T2.

The transfer material P to which the color toner image has been transferred is conveyed to a fixing device 8, where the color toner image is fixed as a color image on the transfer material P, which is then discharged onto a discharge tray 26 on the upper surface of the printer 100 by a plurality of pairs of discharge rollers 25.

The photosensitive drum 1, the charging roller 2, the developing unit 4 and the photosensitive drum unit 6 are integrally made into a cartridge to thereby form a process cartridge main body 7 (7*a*, 7*b*, 7*c*, 7*d*). In the present embodiment, the process cartridge main body 7 and a holding member which will be described later together are called a process cartridge.

Also, the printer 100 has an openable and closable cover integral with the intermediate transfer member 5, and with this openable and closable cover opened, the process cartridge main body 7 is mounted and dismounted with respect to the printer 100 with the photosensitive drum 1 on this side.

The construction of each portion of the above-described printer 100 will now be described in detail.

[Photosensitive Drum]

The photosensitive drum 1 will hereinafter be described in detail. The photosensitive drum 1 is comprised, for example, an aluminum cylinder having a diameter of 30 mm, and an organic photoconductive material layer (OPC photosensitive member) applied to the outer peripheral surface thereof. The photosensitive drum 1 has its opposite end portions rotatably supported by supporting members, and a driving force from a drive motor (not shown) is transmitted to one end portion, whereby the photosensitive drum 1 is rotated counterclockwise in FIG. 3.

[Charging Roller]

A charging roller of a contact roller charging type is used as charging means. The charging roller is an electrically conductive roller formed into a roller shape, and this roller is brought into contact with the surface of the photosensitive drum 1 and a charging bias is applied to this roller, whereby the surface of the photosensitive drum 1 is uniformly charged.

[Scanner Unit]

The scanner unit is such that when an image signal is given to a laser diode, this laser diode applies image light corresponding to the image signal to a polygon mirror (9*a*, 9*b*, 9*c*, 9*d*) rotated at a high speed by a scanner motor. The image light reflected by this polygon mirror is selectively exposed to the surface of the photosensitive drum 1 rotated at a constant speed through an imaging lens, and as the result, an electrostatic latent image is formed on the photosensitive drum 1.

[Developing Unit]

The developing unit 4 is for visualizing the above-mentioned electrostatic latent image on the photosensitive drum 1, and has a toner container 41 which is an example of a developer container containing color toners of Y, M, C and Bk therein, and the toners in the toner container 41 are fed to a toner supplying roller 43 by a toner conveying mechanism 42, and the toners are applied from the toner supplying roller 43 rotated in a clockwise direction to the outer periphery of the developing roller 40 rotated in the clockwise direction in FIG. 3, by a developing blade 44 urged against the outer periphery of a developer carrying member (hereinafter referred to as the developing roller) 40, and charges are imparted to the applied toners.

A developing bias is then applied to the developing roller 40 opposed to the photosensitive drum 1 on which the electrostatic latent image is formed, whereby toner developing is effected on the photosensitive drum 1 in conformity with the latent image.

[Intermediate Transfer Member]

The intermediate transfer member 5 is rotated clockwise in synchronism with the outer peripheral speed of the photosensitive drum 1 for transferring in a multiplex manner the toner image on the photosensitive drum 1 visualized by the process cartridge main body 7 during the operation of the printer 100. The toner image formed on the photosensitive drum 1 is transferred in a multiplex manner onto the intermediate transfer member 5 in the primary transferring portion T1 which is a point of contact with a primary transfer roller (12*a*, 12*b*, 12*c*, 12*d*) which is disposed at a position opposed to the photosensitive drum 1 with the intermediate transfer member 5 interposed therebetween and to which a voltage is applied.

On the intermediate transfer member 5 having received the multiplex transfer, there is formed a multiplex toner image (color toner image) comprising toner images of respective colors superimposed one upon another. The intermediate transfer member 5 is further rotated to the downstream side, and sandwiches and conveys the transfer material P between it and the secondary transfer roller 13 to which a voltage is applied in the secondary transferring portion T2, whereby the color toner image on the intermediate transfer member 5 is transferred to the transfer material P at the same time.

The intermediate transfer member 5 (intermediate transfer belt) according to the present embodiment is formed by a seamless resin belt having a circumferential length of about 620 mm, and is passed over three rollers, i.e., a drive roller 14, a secondary transfer opposed roller 15 and a tension roller 16, and is of a construction in which the opposite ends of the tension roller 16 is loaded by springs and even if the circumferential length of the intermediate transfer member 5 is changed by the temperature and humidity in the main body or a variation with time, the amount of change can be absorbed.

A guide rib (not shown) formed of rubber is attached to the entire periphery of one side edge portion of the inner side of the intermediate transfer member 5 by an adhesive agent. A flange (not shown) having a gradient and formed of resin is disposed on one end portion of the tension roller 16, and the guide rib and the flange together regulate the movement (hereinafter referred to as the "gathering") in a direction orthogonal to the direction of movement of the intermediate transfer member 5.

The intermediate transfer member 5 is supported on the main body of the printer 100 with the drive roller 14 as a fulcrum, and the driving force of a drive motor, not shown, is transmitted to one end of the drive roller 14 on the inner side of the plane of the drawing sheet of FIG. 2, thereby rotating the intermediate transfer member 5 in the clockwise direction in FIG. 2 in conformity with the image forming operation.

[Sheet Feeding Portion]

The sheet feeding portion feeds the transfer material P to the secondary transferring portion T2, and is comprised of chiefly a cassette 17 containing a plurality of sheets of transfer materials P therein, a sheet feeding roller 18, a separating pad 19, a sheet feeding guide 20 and a pair of registration rollers 21. During image forming, the sheet feeding roller 18 is rotatably driven in conformity with the image forming operation to thereby separate and feed the transfer materials P in the cassette 17 one by one, and also guides them by the sheet feeding guide 20, and the transfer material comes to the pair of registration rollers 21. During the image forming operation, the pair of registration rollers 21 perform the non-rotating operation of causing the transfer material P to stationarily stand by and the rotating operation of conveying the transfer material P toward the intermediate transfer member 5 at a predetermined sequence, and effect the alignment of the image and the transfer member P during a secondary transferring step, which is the next step.

[Secondary Transferring Portion]

The secondary transferring portion T2 is provided with the rockable secondary transfer roller 13. The secondary transfer roller 13 comprises a metal shaft wrapped by a medium resistance foamed elastic material, and is movable substantially in a vertical direction and has a drive. In timed relationship with the transfer of the color toner image from the intermediate transfer member 5 to the transfer material P, the secondary transfer roller 13 is pushed into an upper position, i.e., against the intermediate transfer member 5 by a cam member, not shown, with the transfer material P interposed therebetween, with predetermined pressure. At the same time, a bias is applied to the secondary transfer roller 13 and the color toner image on the intermediate transfer member 5 is transferred to the transfer material P.

The intermediate transfer member 5 and the secondary transfer roller 13 are driven and therefore, the transfer material P nipped between the two is subjected to a secondary transferring step and at the same time, is conveyed leftwardly in FIG. 2 at a predetermined speed, and is conveyed toward the fixing device 8 for executing the fixing step which is the next step, by a conveying belt 22.

[Fixing Device]

The fixing device 8 fixes the color toner image formed on the transfer material P, and comprises a film guide unit 23 containing therein a ceramic heater for applying heat to the transfer material P, and a pressure roller 24 for bringing the transfer material P into pressure contact with the film guide unit 23. That is, the transfer material P holding the color toner image thereon is conveyed by the film guide unit 23 and the pressure roller 24 and also has heat and pressure applied thereto, whereby the toners are fused and fixed on the transfer material P.

[Image Forming Operation]

A description will now be provided of the operation when image forming operation is effected by the printer 100 constructed as described above.

First, the sheet feeding roller 18 is rotated to thereby separate a transfer material P in the cassette 17, and conveys it to the pair of registration rollers 21.

On the other hand, each of the photosensitive drum 1 and the intermediate transfer member 5 is rotated in a direction indicated by the arrow in FIG. 1 at a predetermined outer peripheral speed V (hereinafter referred to as the process speed).

The photosensitive drum 1 having had its surface uniformly charged by the charging roller 2 is subjected to laser exposure and effects image forming.

(1) Forming of a Yellow Image

The laser application of a yellow image is effected by the scanner unit 3*a* to thereby form a yellow latent image on the photosensitive drum 1*a*. Simultaneously with the forming of this latent image, the yellow developing unit 4 is driven and a voltage of the same polarity as the charging polarity of the photosensitive drum 1*a* and substantially of the same potential is applied so that the yellow toner may adhere to the latent image on the photosensitive drum 1*a*, to thereby effect yellow developing. At the same time, in the primary transferring portion T1 wherein the primary transfer roller 12*a* downstream of the developing portion is located, the yellow toner image on the photosensitive drum 1*a* is primary-transferred to the outer periphery of the intermediate transfer member 5. At this time, a voltage opposite in polarity to the yellow toner is applied to the primary transfer roller 12*a* on the inner periphery of the intermediate transfer member 5 to thereby effect primary transfer.

(2) Forming of a Magenta Image

Then, the laser application of a magenta image is started by the scanner unit 3*b* at such timing that the leading edge coincides with the yellow image on the outer periphery of the intermediate transfer member 5, and in the same manner as in the case of the yellow image, a magenta toner adheres to the latent image on the photosensitive drum 1*b* by the magenta developing unit 4 and the latent image is magenta-developed, and the magenta toner image on the photosensitive drum 1*b* is superposed on the yellow toner image and transferred onto the intermediate transfer member 5 in the primary transferring portion T1 wherein the primary transfer roller 12*b* is located.

(3) Forming of a Cyan Image

Then, the laser application of a cyan image is started by the scanner unit 3*c* at such timing that the leading edge coincides with the yellow and magenta images on the outer periphery of the intermediate transfer member 5, and in the same manner as in the case of the magenta image, a cyan toner adheres to the latent image on the photosensitive drum 1*c* by the cyan developing unit 4 and the latent image is cyan-developed, and the cyan toner image on the photosensitive drum 1*c* is superposed on the yellow and magenta toner images and transferred onto the intermediate transfer member 5 in the primary transferring portion T1 wherein the primary transfer roller 12*c* is located.

(4) Forming of a Black Toner Image

Then, the laser application of a black image is started by the scanner unit 3*d* at such timing that the leading edge coincides with the yellow, magenta and cyan images on the outer periphery of the intermediate transfer member 5, and in the same manner as in the case of the cyan image, a black toner adheres to the latent image on the photosensitive drum 1*d* by the black developing unit 4 and the latent image is black-developed, and the black toner image on the photosensitive drum 1*d* is superposed on the yellow, magenta and cyan toner images and transferred onto the intermediate transfer member 5 in the primary transferring portion T1 wherein the primary transfer roller 12*d* is located.

As described above, in the order of Y, M, C and Bk, latent image forming, developing and toner transfer to the intermediate transfer member 5 are effected at the positions of the respective primary transfer rollers 12*a*, 12*b*, 12*c* and 12*d* in the primary transferring portion T1 and thus, a full-color image (color toner image) comprising four kinds of toners, i.e., Y, M, C and Bk toners, are formed on the surface of the intermediate transfer member 5.

Before the leading edge of the image on the intermediate transfer member 5 on which the full-color image has been formed after the primary transfer of the fourth color, i.e., black toner has been finished arrives at the secondary transferring portion T2, the aforedescribed transfer material P caused to stand by at the pair of registration rollers 21 begins to be conveyed in timed relationship with the full-color image.

At this time, the secondary transfer roller 13 which stood by below and was in non-contact with the intermediate transfer member 5 during the forming of the images of the four colors on the intermediate transfer member 5 is upwardly moved by a cam (not shown).

The transfer material P is urged against the secondary transferring portion T2 by the use of the secondary transfer roller 13 and the secondary transfer opposed roller 15 and at the same time, a bias opposite in polarity to the toners is applied to the secondary transfer roller 13, whereby the full-color image on the intermediate transfer member 5 is collectively transferred to the transfer material P.

The transfer material P passed through the secondary transferring portion T2 is stripped off from the intermediate transfer member 5, is conveyed to the fixing device 8 and is subjected to toner fixing there, whereafter it is discharged onto a discharge tray 26 in the upper portion of the printer 100 through a pair of discharge rollers 25 with its image surface facing down, thus completing the image forming operation.

[Construction of the Process Cartridge Main Body]

Figure 4:
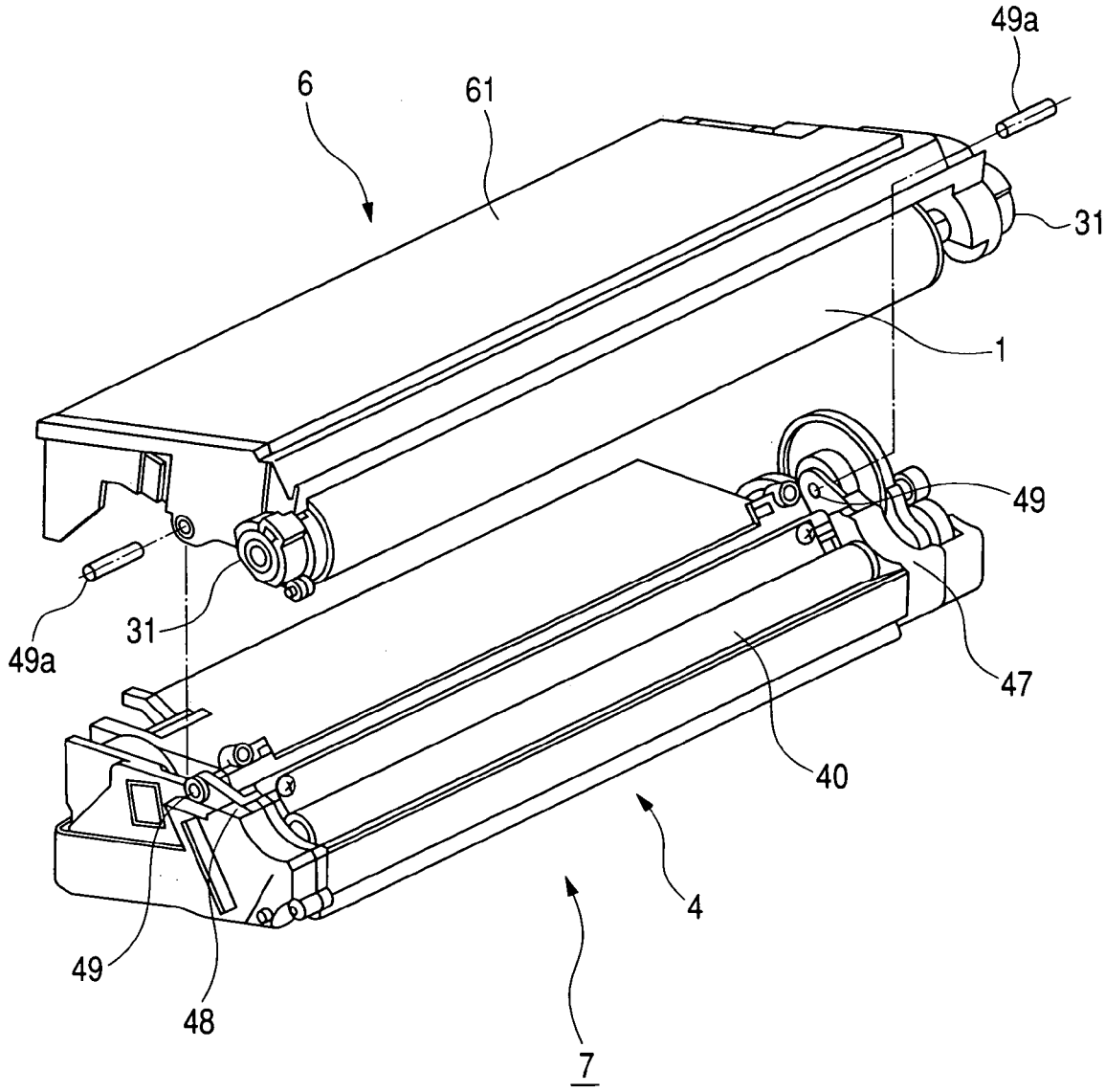
FIG. 4 is a perspective view showing the process cartridge according to the embodiment of the present invention.

The process cartridge main body which has embodied the present invention will now be described in detail with reference to FIGS. 3 and 4. FIGS. 3 and 4 show a main cross section and a perspective view, respectively, of the process cartridge main body 7 containing the toners therein. The Y, M, C and Bk process cartridge main bodies 7*a*, 7*b*, 7*c* and 7*d* are of the same construction.

As shown in FIG. 3, the process cartridge main body 7 is divided into a photosensitive drum unit 6 which is a first frame member having a drum-shaped electrophotographic photosensitive member, i.e., a photosensitive drum 1, as an image bearing member, and a developing unit 4 which is a second frame member having a developing roller 40 for developing the electrostatic latent image on the photosensitive drum 1. Also, the photosensitive drum unit 6 is provided with a charging roller 2 and a cleaning blade 60. As will be described later, when the developing roller and the photosensitive drum are to be spaced apart from each other, it is advantageous in rotating accuracy and positioning accuracy and the toner container for containing the developer can be constructed to be large if they are thus supported by discrete frame members and the frame members are brought into contact with each other.

As shown in FIG. 4, in the photosensitive drum unit 6, the photosensitive drum 1 is rotatably mounted on a cleaning frame member 61 constituting a first frame member through a bearing member 31. On the periphery of the photosensitive drum 1, there are disposed the charging roller 2 for uniformly charging the surface of the photosensitive drum 1, and the cleaning blade 60 for removing any toner residual on the photosensitive drum 1.

Figure 7:
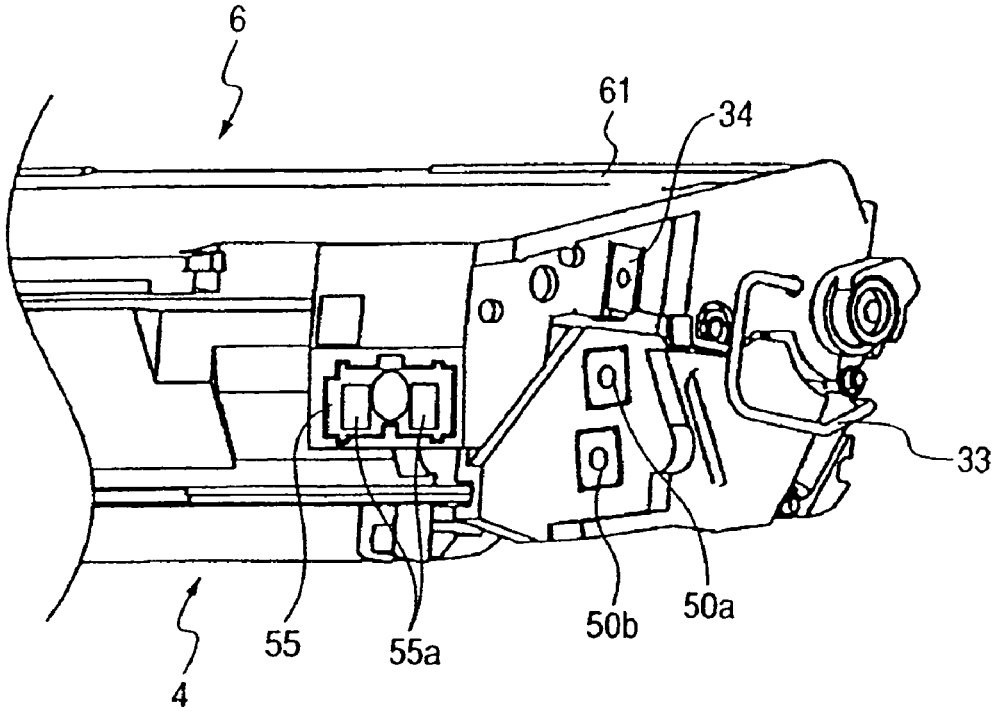
FIG. 7 is a rear perspective view of the process cartridge according to the embodiment of the present invention.
Figure 8:
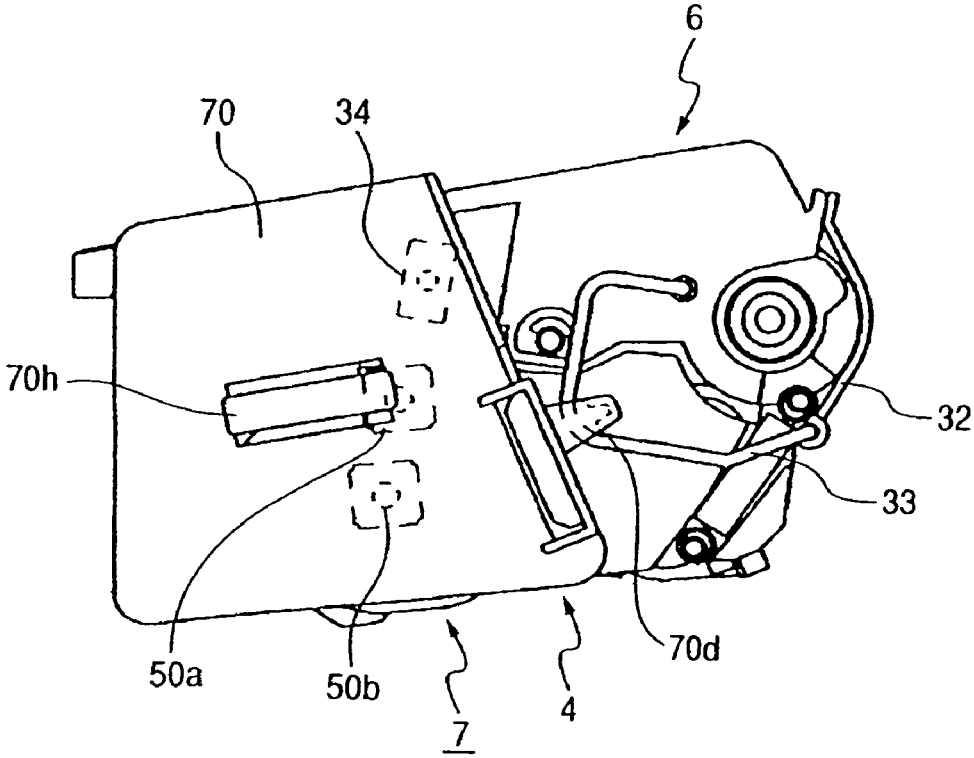
FIG. 8 is a side view of the process cartridge on which the space holding member according to the embodiment of the present invention is mounted.
Figure 9:
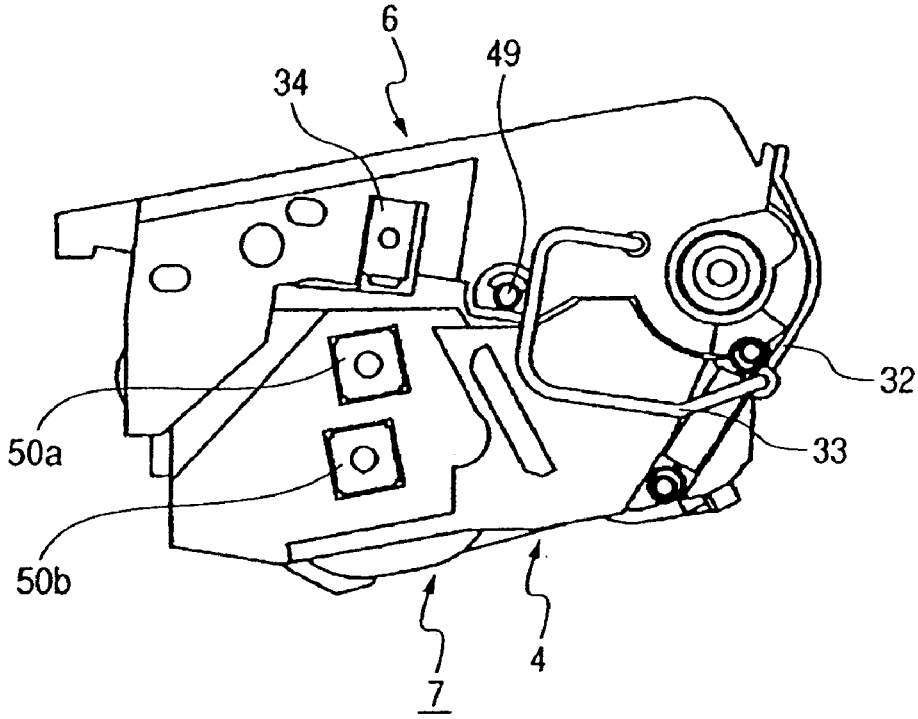
FIG. 9 is a side view of the process cartridge according to the embodiment of the present invention.

A charging bias is applied to the charging roller 2 by a voltage source (not shown) in the printer 100 through a charging contact 34 (see FIGS. 7 to 9).

The residual toner removed from the surface of the photosensitive drum 1 by the cleaning blade 60 is sequentially fed to a waste toner chamber 63 provided rearwardly of the cleaning frame member 61 by a toner feeding mechanism 62.

Figure 1:
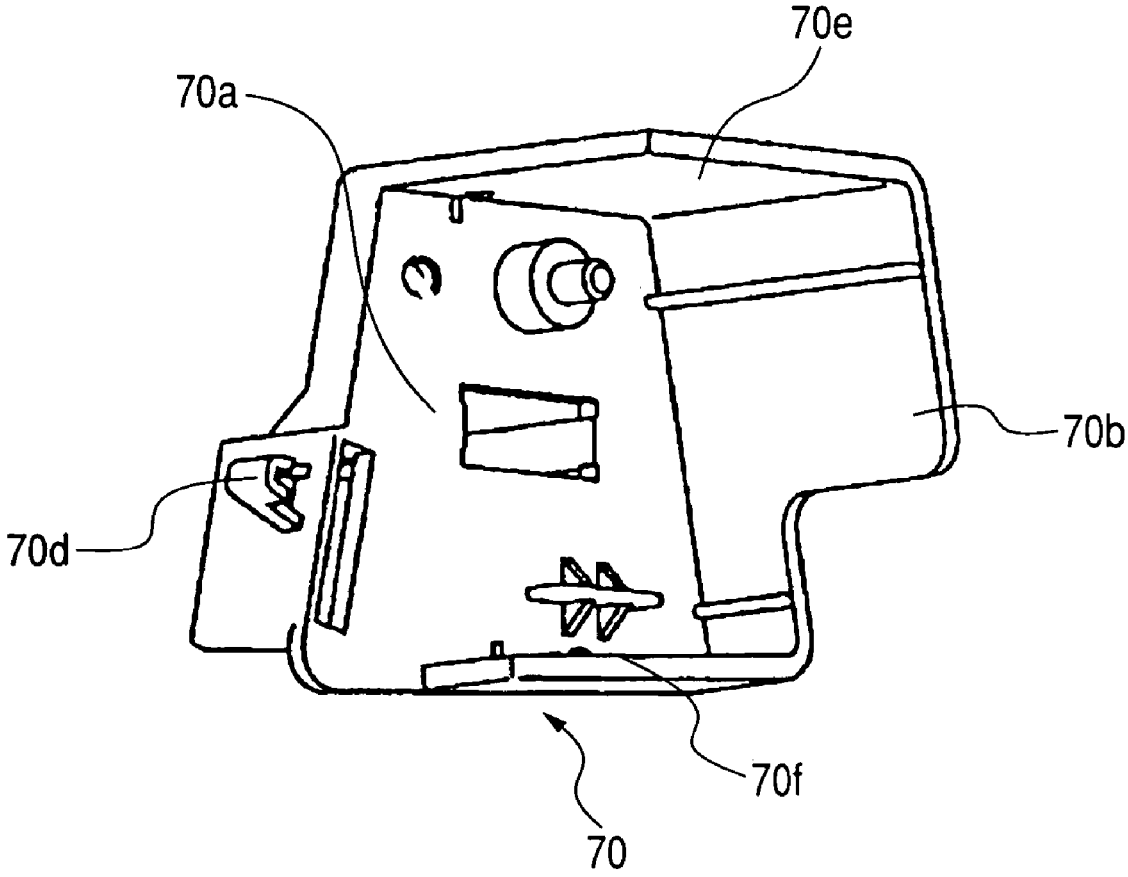
FIG. 1 is perspective view of a space holding member according to an embodiment of the present invention.

The driving force of a drive motor (not shown) is transmitted to an inner end of the photosensitive drum 1 which is shown in FIG. 4, whereby the photosensitive drum 1 may be rotatably driven counterclockwise in FIG. 1 in conformity with the image forming operation.

The photosensitive drum 1 in the process cartridge main body 7, if exposed to outdoor daylight for a long time, deteriorates, and may be damaged or may permit a foreign substance to adhere to its surface if the photosensitive drum 1 is exposed during the handling thereof outside the printer 100. In order to eliminate the possibility of such deterioration or damage, a drum shutter 32 is provided as an example of protecting means for opening and closing an opening portion for exposing the photosensitive drum 1 in the process cartridge main body 7 (see FIGS. 8 and 9). The drum shutter 32 is designed to open the opening portion of the process cartridge main body 7 to thereby expose the photosensitive drum 1 when the process cartridge main body 7 is mounted on the printer 100, but to close the opening portion in the other states.

That is, the drum shutter 32 is provided for movement between a shielding position for covering the opening portion of the cartridge frame member for exposing a portion of the photosensitive drum 1 and a retracted position retracted from this shieldig position for opening the opening portion. The design is made such that when the opening portion is covered with the drum shutter, a portion of the photosensitive drum 1 is covered with the drum shutter, and when the opening portion is opened by the drum shutter, a portion of the photosensitive drum 1 is exposed. The drum shutter 32 shown in the present embodiment is rotatably mounted on the cleaning frame member 61 through a shutter shaft 33 and an arm member, not shown, and is biased by a shutter spring (not shown) so as to maintain the shielding position. The drum shutter 32 is moved between the shielding position and the retracted position by the rotation of the shutter shaft 33.

On the other hand, the developing unit 4 is comprised of a developing roller 40 being in contact with the photosensitive drum 1 and rotated in the direction indicated by the arrow Y, a toner container 41 in which the toner is contained and a developing container 45. The developing unit 4 is formed as a second frame member.

The developing roller 40 is rotatably supported on the developing container 45 through developing bearings 47 and 48, and on the periphery of the developing roller 40, there are disposed a toner supplying roller 43 which is in contact with the developing roller 40 and rotated in the direction indicated by the arrow Z and a developing blade 44.

Further, in the toner container 41, there is provided a toner conveying mechanism 42 for agitating the contained toner and conveying it to the toner supplying roller 43.

In the toner container 41, there is provided a toner opening 41*a* for supplying the toner to the developing roller 40 side. In the unused state of the process cartridge main body 7, in order to prevent the toner from leaking out from the toner opening 41*a*, a film-like toner seal 39 as an example of seal means is removably mounted in this toner opening 41*a* (see FIG. 6). When the process cartridge main body 7 is used, this toner seal 39 is stripped off; whereafter the process cartridge main body is mounted on the printer 100.

As shown in FIG. 4, the developing unit 4 is of suspended structure in which the entire developing unit 4 is supported for pivotal movement relative to the photosensitive drum unit 6 about supporting holes in coupling portions 49 provided on the developing bearings 47 and 48 mounted on the axially opposite ends of the developing roller 40 of the developing unit 4, by coupling pins 49*a*.

When the process cartridge main body 7 is a single body (is not mounted on the main body of the printer 100), the photosensitive drum unit 6 and the developing unit 4 are always biased by a pressure spring 64 as an example of a biasing member disposed on a side opposite to the photosensitive drum 1 with a coupling pin 49*a* interposed therebetween so that the developing roller 40 may be brought into contact with the photosensitive drum 1 about the coupling pin 49*a* by an angular movement.

When during developing, the contained toner is conveyed to the toner supplying roller 43 by the toner conveying mechanism 42, the toner supplying roller 43, being rotated in the direction indicated by the arrow Z, supplies the toner to the developing roller 40 by the frictional contact thereof with the developing roller 40 being rotated in the direction indicated by the arrow Y, and the toner is carried on the developing roller 40.

The toner carried on the developing roller 40 comes to the developing blade 44 with the rotation of the developing roller 40, and the developing blade 44 imparts charges to the toner and also forms a predetermined thin layer of toner.

The toner is then conveyed to a developing portion in which the photosensitive drum 1 and the developing roller 40 are in contact with each other, and adheres to the electrostatic latent image formed on the surface of the photosensitive drum 1 in the developing portion by a DC developing bias applied from a voltage source, not shown, in the printer 100 to the developing roller 40, the toner supplying roller 43 and the developing blade 44 through developing contacts 50*a* and 50*b*, thereby developing the latent image (see FIGS. 7 to 9).

Any residual toner on the surface of the developing roller 40 without contributing to developing is returned into the developing unit 4 with the rotation of the developing roller 40, and is stripped off and collected from the developing roller 40 in the frictional contact portion with the toner supplying roller 43. The collected toner is agitated and mixed with the remaining toner by the toner conveying mechanism 42.

In a contact developing process wherein developing is effected with the photosensitive drum 1 and the developing roller 40 in contact with each other, it is preferable that the photosensitive drum 1 be a rigid member and the developing roller 40 used therewith be a roller having an elastic member. As this elastic member, use is made of a solid rubber single layer or a solid rubber layer provided with resin coating thereon with the charge imparting property to the toner taken into account.

Also, the toner supplying roller 43 is an elastic roller comprising a mandrel portion and a sponge portion, which is formed of an open-cell foam.

[Construction of the Storage Means of the Process Cartridge Main Body]

Reference is now had to FIG. 7 to describe the construction of a storing medium provided on the process cartridge main body 7, and the communication of the storing medium with the printer 100. The storing medium (hereinafter referred to as the memory unit) 55 is provided on the outer peripheral surface of the process cartridge main body 7.

Also, the printer 100 is provided with a communication unit (not shown) connected to a controller (not shown), and when the process cartridge main body 7 is mounted on the printer 100, a communication contact portion 55*a* which is an example of the communication means of the memory unit 55 and the communication contact portion of the communication unit come into contact with each other, and the storing element of the memory unit 55 and the controller become capable of communicating with each other, and the reading and writing of the information of the storage element become possible. If the reading and writing of the information can be effected, the communication contact portion 55*a* of the process cartridge main body and the communication contact portion of the communication unit may be out of contact with each other.

The memory unit 55 is mounted on the process cartridge main body 7 by means such as two-sided tape, an adhesive agent, heat caulking, ultrasonic welding or a snap fit. Also, the process cartridge main body 7 is positioned in the printer 100 by a positioning member provided on the photosensitive drum unit 6 and therefore, by being mounted on the photosensitive drum unit 6 of the process cartridge main body 7, the memory unit 55 becomes capable of being accurately positioned with respect to the communication unit of the printer 100.

[Construction of the Space Holding of the Developing Roller]

The developing roller 40 is comprised of a mandrel portion 40*a* and a rubber portion 40*b*, and is designed to be brought into contact with the photosensitive drum 1 by the pressure spring 64 during image forming operation.

In the distribution process, however, the developing roller 40 is left in contact with the photosensitive drum 1 for a long period, and in order to eliminate the possibility of the rubber portion 40*b* of the developing roller following the surface shape of the photosensitive drum 1, the design is made such that a space holding member 70 (FIGS. 1, 5 and 6), which is a holding member for the developing roller 40, is made to act (is mounted) on the process cartridge main body 7, whereby a state in which the developing roller 40 and the photosensitive drum 1 are spaced apart from each other can be held.

The space holding member 70 is detached from the process cartridge main body 7 to thereby bring about a state in which the developing roller 40 and the photosensitive drum 1 can contact with each other, whereafter the process cartridge main body 7 is mounted on the printer 100. Also, in a case where the process cartridge main body 7 is not used for a long period and is taken out of the printer 100 and is kept in custody, the space holding member 70 is again mounted on the process cartridge main body 7, whereby it is possible to again hold the developing roller 40 and the photosensitive drum 1 in their mutually spaced-apart state.

The constructions of the space holding member 70 of the developing roller 40 and the process cartridge main body 7 using the same will now be described in detail with reference to FIGS. 1 and 5 to 9.

Figure 5:
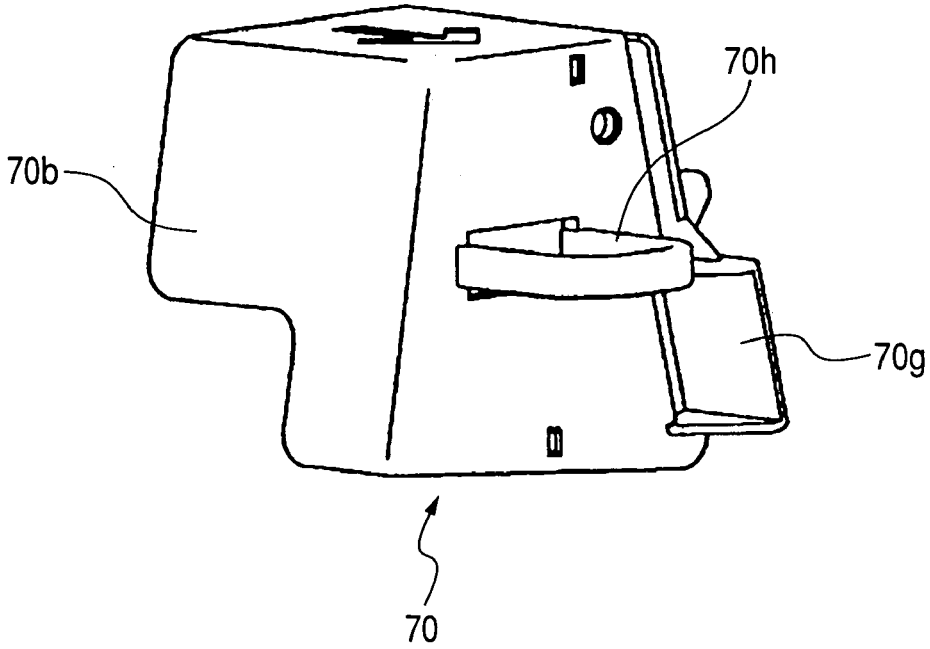
FIG. 5 is a perspective view of a space holding member according to an embodiment of the present invention.

The space holding member 70 of the developing roller 40 shown in the present embodiment is shown in FIGS. 1 and 5. This space holding member 70 is engaged with the upper surface of the cleaning frame member 61 and the underside of the developing unit 4 from the axial end of the photosensitive drum 1 of the process cartridge main body 7 to thereby hold the developing roller 40 in spaced-apart relationship with the photosensitive drum 1 (see FIG. 6).

The cleaning frame member engaging portion 70*e* and the developing unit engaging portion 70*f* of the space holding member 70 are provided with snap fit shapes, whereby the space holding member 70 is prevented from coming off from the process cartridge main body 7 (see FIG. 1).

Also, the space holding member 70 is provided with a handle portion 70*h*, and by hooking fingers on it, and pulling it in the axial direction of the photosensitive drum 1 (the direction indicated by the arrow V in FIG. 6), it is possible to detach the space holding member from the process cartridge main body 7 (see FIG. 5).

Also, the handle portion 70*h* of the space holding member 70 greatly juts out toward the axial end of the photosensitive drum 1 of the process cartridge main body 7 and therefore, with the space holding member 70 mounted, it is impossible to mount the process cartridge main body 7 on the printer 100. Thereby, the user can be prevented from forgetting to remove the space holding member 70 when he handles the printer.

A contact protecting portion 70*a*, which is a portion for covering and hiding the electrical contacts of the space holding member 70, covers a charging contact 34 and developing contacts 50*a*, 50*b* provided on a side of the process cartridge main body 7 (see FIG. 8).

Figure 6:
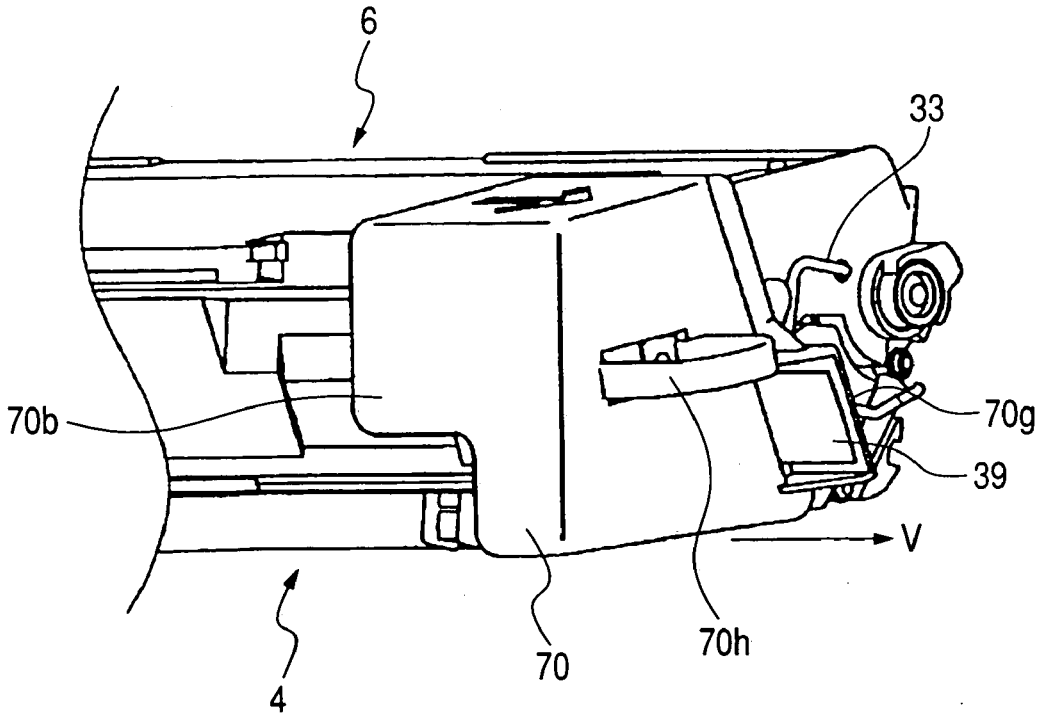
FIG. 6 is a rear perspective view of a process cartridge on which the space holding member according to the embodiment of the present invention is mounted.

Also, the memory protecting portion 70*b* of the space holding member 70, which is a portion for covering and hiding the storage medium, covers the memory unit 55 provided on the opposite side of the photosensitive drum 1 of the process cartridge main body 7 and the communication contact portion 55*a* thereof (see FIGS. 6 and 7).

Covering and hiding refers to such a shape that protects the storage medium and the electrical contacts during conveyance or the like, and is not restricted to the shape of the present embodiment.

The shutter restraining portion 70*d* of the space holding member 70 restrains a shutter shaft 33 (see FIG. 8). Thereby, the drum shutter 32 is prevented from being inadvertently opened by the space holding member 70.

The space holding member 70 of the above-described construction is mounted and thereby becomes capable of protecting the memory unit 55, the charging contact 34 and the developing contacts 50*a*, 50*b* of the process cartridge main body 7, and further preventing the drum shutter 32 from being inadvertently opened.

In addition, the space holding member 70 is provided with a toner seal fixing portion 70*g*, which can fix the toner seal 39 attached to the toner container 41 (see FIG. 6).

Thus, by the space holding member 70 being removed, not only do the photosensitive drum 1 and the developing roller 40 become capable of contacting each other, but also the opening of the toner seal 39 and the exposure of the electrical contact portions (the charging contact 34 and the developing contacts 50*a*, 50*b*) can be effected at a time, and it is possible to mount the process cartridge main body 7 on the printer 100 and bring it into a usable state.

That is, by the single operation of removing the space holding member 70, the photosensitive drum 1 and the developing roller 40 become capable of contacting each other, and the communication contact portion 55*a*, the charging contact 34 and the developing contacts 50*a*, 50*b* can be exposed to the printer 100, and the unlocking of the drum shutter 32 of the photosensitive drum 1 becomes possible and further, even the opening of the toner seal 39 can be completed and therefore, it becomes possible to enhance the stability of quality and yet keep usability good.

While in the present embodiment, the space holding member 70 has been described as holding the developing roller 40 in a state spaced apart from the photosensitive drum 1, this is not restrictive. For example, even if the developing roller 40 and the photosensitive drum 1 are not brought into a completely spaced-apart state, the developing roller 40 and the photosensitive drum 1 are held so that the contact pressure between the developing roller 40 and the photosensitive drum 1 may become smaller than the contact pressure in a pressure state when image forming is effected (a pressure release state), whereby the problem of the permanent deformation of the developing roller is alleviated. That is, the holding member 70 is mounted on the process cartridge main body, the photosensitive drum 1 and the developing roller 40 are held in one of the spaced-apart state and the pressure released state. When the holding member 70 has been detached from the process cartridge main body, the photosensitive drum 1 and the developing roller 40 can come into contact with each other.

Also, while in the present embodiment, the developing roller has been described as an example of process means for spacing the photosensitive drum and the developing roller apart from each other, the charging roller 2 may be spaced apart from the photosensitive drum 1, or the developing roller 40 and the charging roller 2 may be spaced apart from the photosensitive drum 1 at a time.

While in the present embodiment, the space holding member 70 is an integrally molded member, this is not restrictive. For example, even though the member for spacing the process means apart from each other and the member for covering and hiding the storage medium are constituted by discrete members, if the discrete members are connected to each other, and the spaced-apart state of the process means can be released and the memory unit and the contacts can be exposed, by a single operation, it is within the scope of the present invention.

Second Embodiment

Figure 10:
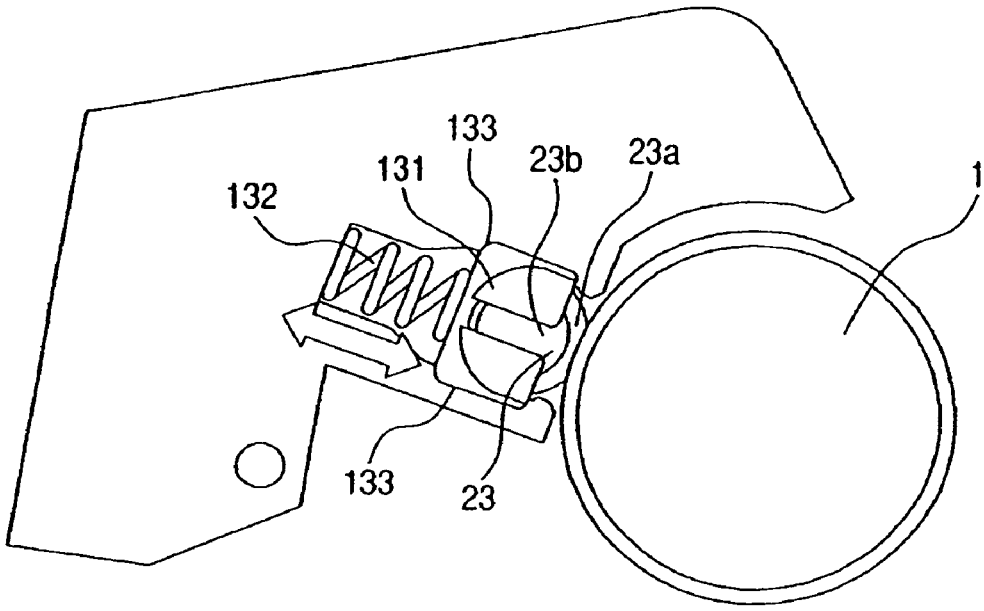
FIG. 10 is a schematic side view of a charging roller according to an embodiment of the present invention.

This embodiment is of the same construction as the first embodiment and a duplicate description will be omitted. In the present embodiment, the space holding member of the first embodiment is provided with means for spacing the charging roller apart, in addition to the means for spacing the developing roller 40 apart. The present embodiment is characterized by this means for spacing the charging roller apart from the drum 1. The charging roller 23 in the present embodiment and the supporting construction of the charging roller will first be described with reference to FIG. 10. The charging roller 23 is constituted by a mandrel 23*b* and an electrically conductive rubber member 23*a* formed around it, and is urged against the photosensitive drum 1 by a pressure spring (biasing member) 132 through a bearing. The charging roller 23 is rotatably supported on a charging roller bearing 131, which in turn is supported on a guide portion 133. The charging roller bearing 131 and the guide portion 133 are slidable relative to each other, and the charging roller 23 is rotatable and is also movable in the direction indicated by the arrow in FIG. 10 (a direction toward and away from the photosensitive drum 1). The charging roller, unlike the developing roller, is not required to have severe positioning accuracy or the like and therefore, it is better in avoiding a complicated construction that a spacing mechanism be provided as means for spacing the charging roller apart by the same frame member.

(Spacing Mechanism for the Charging Means)

Figure 11:
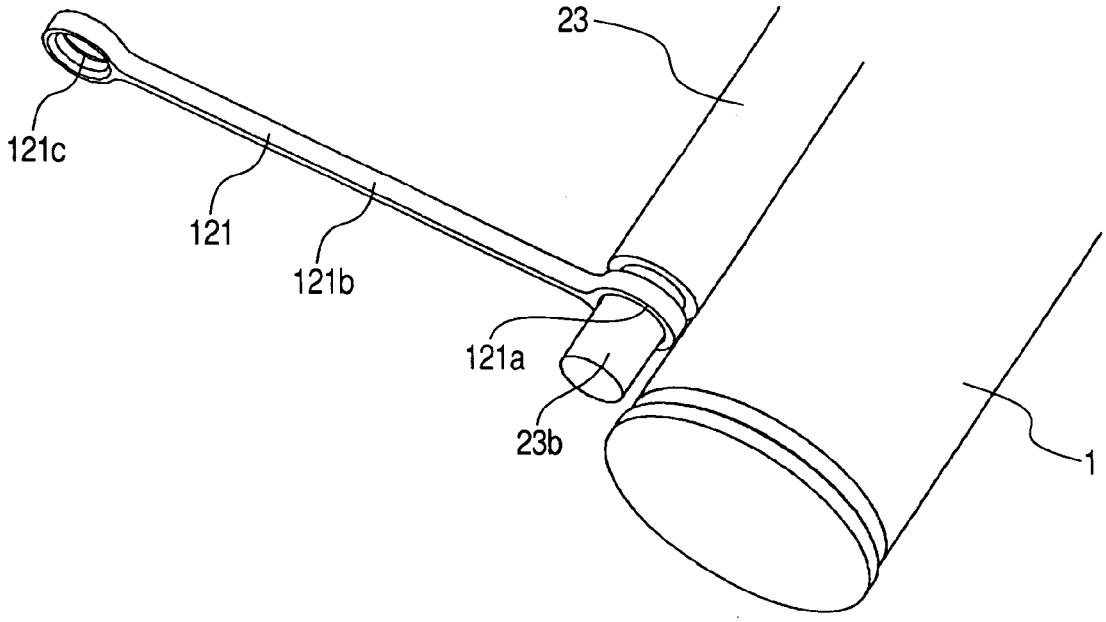
FIG. 11 is a schematic perspective view of the charging roller and a supporting member according to the embodiment of the present invention.
Figure 12A:
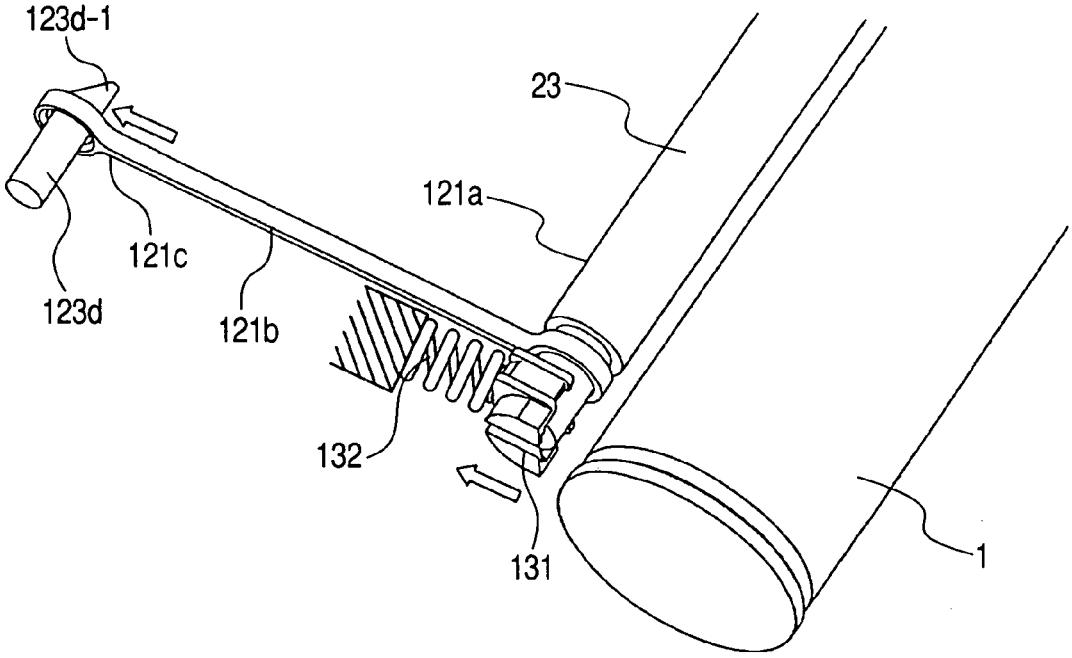
FIGS. 12A and 12B are schematic perspective views of the charging roller, the supporting member and the space holding member according to the embodiment of the present invention.
Figure 12B:
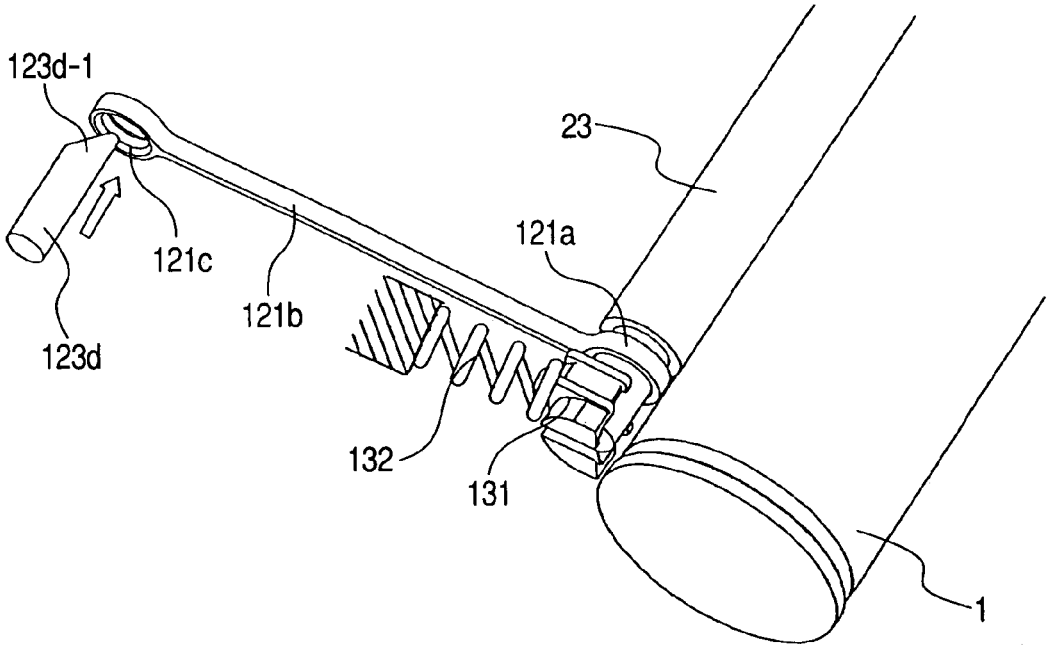

Reference is now had to FIGS. 11, 12A and 12B to describe a supporting member 121, a space holding member 123 which is a holding member, a bar-shape portion 123*d* which is a portion of the space holding member 123 and is bar-shaped, and an acting portion 123*d–l* by which the bar-shaped portion 123*d* acts on the supporting member 121. The supporting member 121 is formed by a bearing portion 121*a*, a connecting portion 121*b* and an acting hole portion 121*c*, and the charging roller mandrel 23*b* is slidable on the bearing portion 121*a*. The bearing portion 121*a* is designed so as not to contact with the photosensitive drum 1, and by doing so, it does not injure the surface of the photosensitive drum 1. A charging moving portion 123*d* moves the charging roller 23 toward and away from the photosensitive drum 1 through the supporting member by the acting portion 123*d–l* being inserted into the acting hole portion 121*c* of the supporting member 121. The inserted position is regulated by providing an insertion hole, not shown, in a photosensitive drum frame member.

(Spacing the Charging Roller Apart)

A construction for moving the charging roller will now be described with reference to FIGS. 12A and 12B. With the charging roller 23 being in contact with the photosensitive drum 1, the space holding member 123 is mounted on the process cartridge main body to thereby insert the bar-shaped portion 123*d* through an insertion hole, not shown, formed in the cartridge frame member, whereupon the acting portion 123*d–l* enters the acting hole portion 121*c*, and when the bar-shaped portion 123*d* is further inserted, the acting hole portion 121*c* is moved because the tip end of the acting portion 123*d–l* is provided with an inclination. The movement of the acting hole portion 121*c* is transmitted to the bearing portion 121*a* through the connecting portion 121*b* to thereby move the charging roller 23 away from the photosensitive drum. It is preferable that the direction of movement of the supporting member 121 be substantially the same direction as the direction of the guide portion 133 of the charging roller bearing 131 and a phantom line linking the center of the photosensitive drum and the center of the charging roller together. With regard also to the lengthwisely opposite side, not shown, the charging roller 23 is spaced apart by a similar construction and the pressure applied to the charging roller is released. Because of a mechanism in which as described above, the charging roller 23 is not directly acted on, but is acted on through the supporting member supporting the charging roller, a special design such as forming an insertion hole in the frame member around the charging roller of which accuracy and rigidity are required becomes unnecessary.

Also, an upper bar portion formed with an inclination at the tip end thereof is provided on the space holding member and the supporting member is made into a hole to thereby simply put the space holding member into and out of it, whereby the contacting and spacing-apart of the charging roller can be adjusted, and it is unnecessary to especially provide a complicated mechanism.

Also, even after the spaced-apart state of the charging roller has once been released, the contacting and spacing-apart of the charging roller can be repetitively manually effected and therefore, when image forming is not effected for a long period after the spacing-apart of the charging roller has been released and the process cartridge main body has begun to be used, the spacing-apart member is made to act on the process cartridge main body, whereby the charging roller can be again spaced apart.

Also, by adopting a construction in which the charging moving member is moved substantially perpendicularly to the contacting and spacing-apart direction of the charging roller 23 to thereby effect the contacting and spacing-apart of the charging roller 23, a simple construction is provided without providing a new mechanism on the extension of the widthwise direction of the charging moving member.

While in the present embodiment, the charging roller 23 and the photosensitive drum 1 are completely spaced apart from each other by the charging moving member 123*d*, there may be adopted a construction in which the charging roller 23 is moved a little in the spacing-apart direction to release the pressure between the charging roller and the photosensitive drum. That is, whether the charging roller and the photosensitive drum are completely spaced apart from each other has nothing to do in the case of a construction in which during non-image forming during which image forming is not effected, the space holding member 123 is mounted on the process cartridge main body 2 to thereby bring about a state in which the pressure between the charging roller and the photosensitive drum has been released, and when image forming is effected, that is, when developing is effected, the relative position in the contacting and spacing-apart direction is determined by the charging moving member so that the space holding member 123 can be detached from the process cartridge main body and can be moved into a contacting state in which the charging roller can perform its function.

Figure 14:
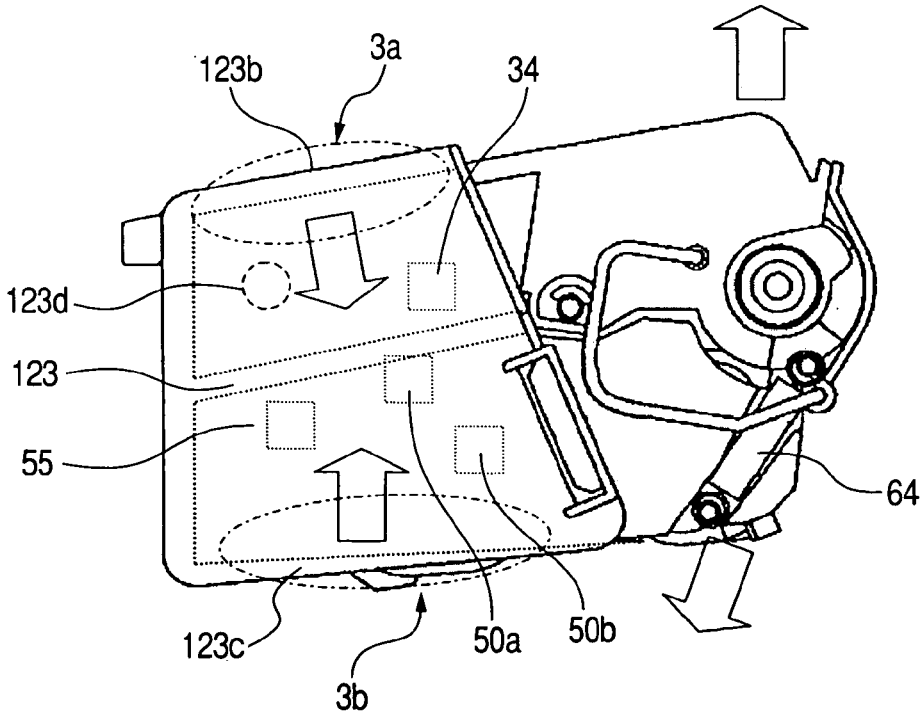
FIG. 14 is a schematic perspective view of the process cartridge during the mounting of the space holding member according to the embodiment of the present invention.

In the present embodiment, the space holding member 123 is adapted to be used as the space holding member of the developing means and the space holding member of the charging means. That is, the space holding member 123 has developing space acting portions 123*b* and 123*c*, and by these acting on the process cartridge main body, the developing roller 40 and the photosensitive drum 1 are spaced apart from each other. When as shown, for example, in FIG. 14, image forming is not effected such as during transportation or when the printer is left as it is for a long period, the space holding member is mounted-on the process cartridge main body, whereby the top surface of the space holding member grasps the top surface 3*a* of the photosensitive drum unit and the bottom surface 123*c* of the space holding member grasps the bottom surface 3*b* of the developing unit, and against the biasing force of a spring 64, the developing roller 40 and the photosensitive drum 1 can be brought into a non-pressure state.

Also, as in the first embodiment, the space holding member 123 can be used to protect the memory unit 55, the charging contact 34 and the developing contacts 50*a*, 50*b*, prevent the drum shutter 32 from being inadvertently opened, and open the toner seal. In this case, by removing the space holding member 123, not only does the contact between the photosensitive drum 1 and the charging roller becomes possible, but also it is possible to effect the contacting of the developing roller 40, the opening of the toner seal 39 and the exposing of the electrical contact portions (the charging contact 34 and the developing contacts 50*a*, 50*b*) at a time, and the process cartridge main body 7 can be mounted on the printer 100 and be brought into a usable state. Accordingly, usability is improved.

Third Embodiment

This embodiment is characterized in that the spacing-apart member and the toner seal are connected together.

Figure 13:
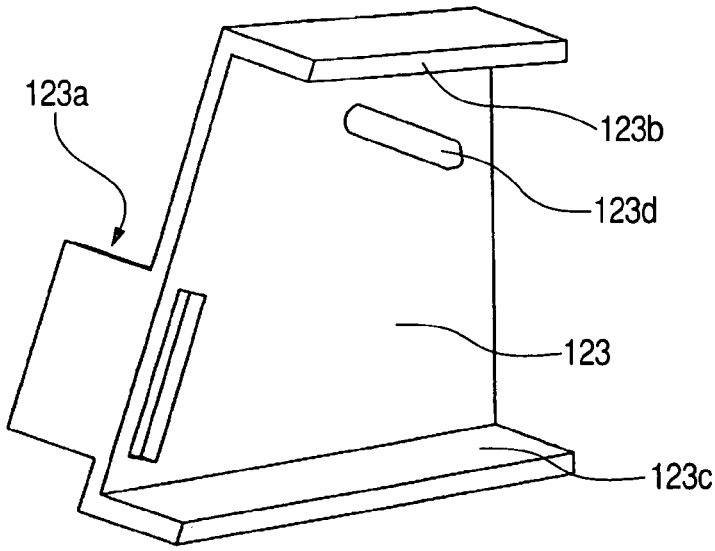
FIG. 13 is a schematic perspective view of the space holding member according to the embodiment of the present invention.

The construction of the present embodiment is substantially the same as the construction of the second embodiment, but as shown in FIG. 13, the present embodiment is of a construction in which the end portion of a toner seal is attached to the toner seal attaching surface 123*a* of the space holding member 123. By adopting such a construction, when the user opens the toner seal, the spaced-apart state of the charging roller 23 and the spaced-apart state of the developing roller are released and therefore, the possibility of forgetting to pull out the charging moving member becomes null. Also, a construction for realizing this can be made very simple.

Fourth Embodiment

This embodiment is characterized in that the toner seal has an excess length.

Figure 15:
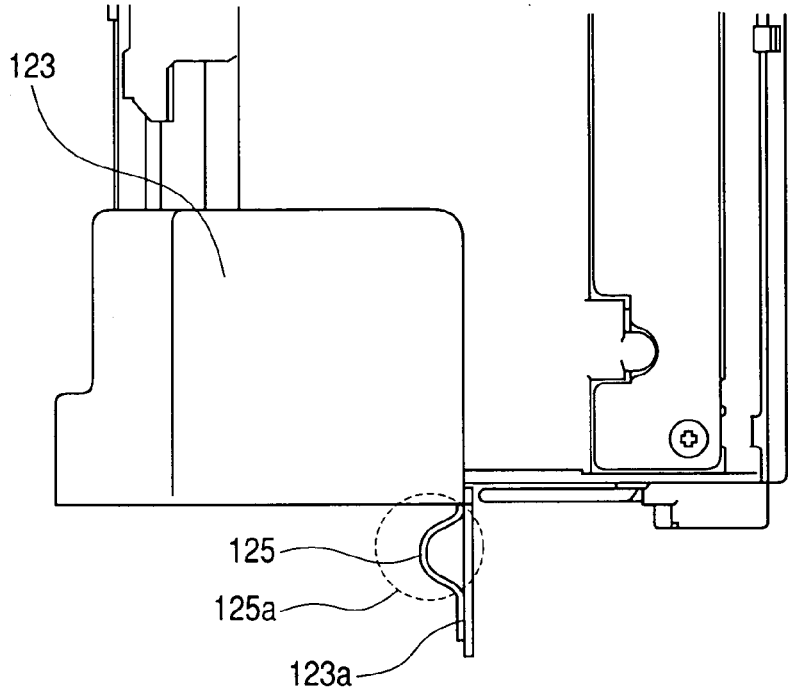
FIG. 15 is a schematic view of the process cartridge during the mounting of the spacer member to which a toner seal according to an embodiment of the present invention is fixed.
Figure 16:
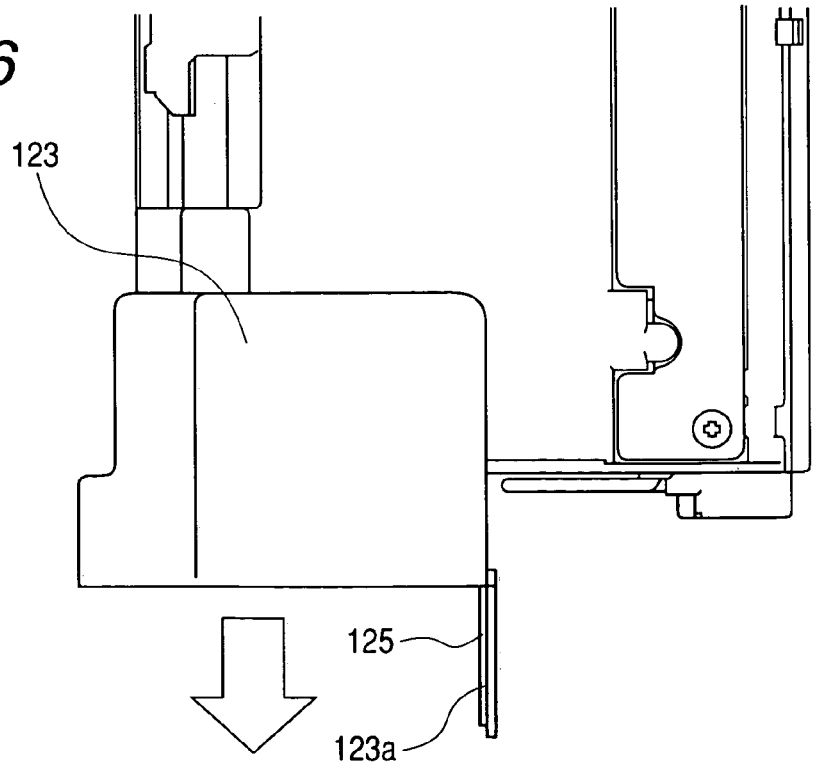
FIG. 16 is a schematic view of the process cartridge when the spacer member to which the toner seal according to the embodiment of the present invention is fixed has been moved to a first position.

The construction of the present embodiment, like that of the third embodiment, is such that the toner seal is connected to the spacing-apart member. FIG. 15 shows a state in which the space holding member 123 is attached to the cartridge frame member, and FIG. 16 shows a state in which the space holding member 123 is pulled out from the cartridge frame member to a predetermined position which is a first position, and the developing roller and the charging roller are in contact with the photosensitive drum. The toner seal 125 has an excess length portion 125*a* in the state in which the space holding member 123 is attached to the cartridge frame member. The length of the excess length portion 125*a* is set so that the excess length portion may become null after the space holding member 123 has been pulled out from the cartridge frame member and the developing space and the charging space have been released. That is, in case of the detachment of the spacing-apart member, when the space holding member 123 has been moved to the first position (see FIG. 16), the developing space and the charging space are released, but at that time, the two-stage step that the opening of the toner seal is not done, but next, the spacing-apart member is further moved from the first position to a second position, whereby the opening of the toner seal takes place is fulfilled. The design is made such that by doing so, a pulling-out force $F_1$ necessary during spacing release and a pulling-out force $F_2$ necessary when the toner seal is pulled out do not act at a time.

The present embodiment is described as being of a construction in which the space holding member 123 serves as a charging spacing member and a developing spacing member, but also by adopting a construction in which the toner seal is attached to only the charging spacing member (a construction having no spacing construction for the developing roller) or only the developing spacing member (a construction having no moving construction for the charging roller) with an excess length, there can be obtained the effect that the pulling-out force $F_1$ necessary for spacing release and the pulling-out force $F_2$ necessary when the toner seal is pulled out do not act at a time. Consequently, the pulling-out of the spacing-apart member and the pulling-out of the toner seal can be achieved with a relatively light force.

Figure 17:
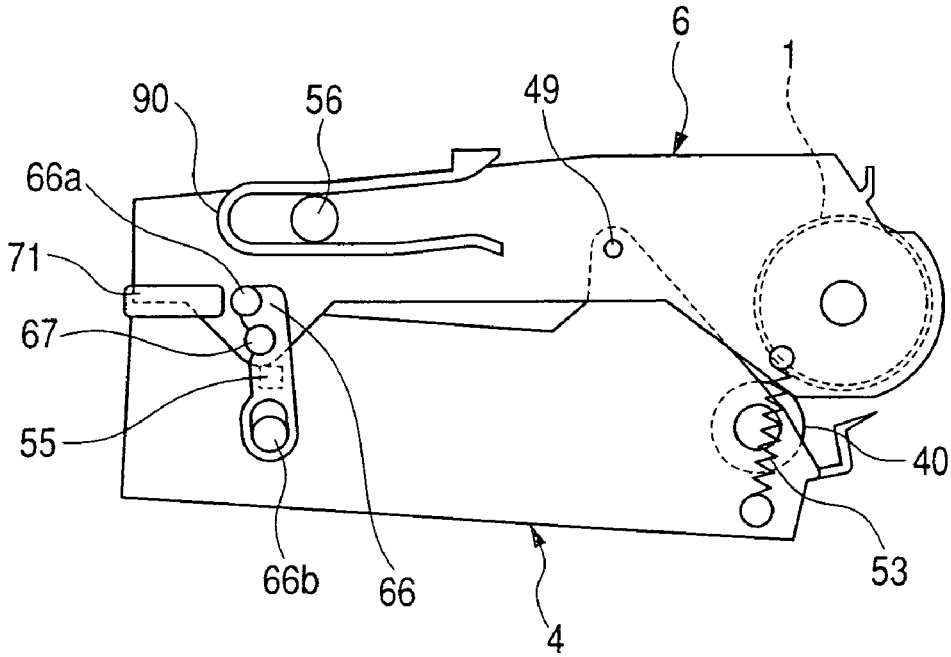
FIG. 17 is a schematic view of the process cartridge when a hook according to an embodiment of the present invention is acting on the process cartridge.

While the above-described embodiment is a construction in which the space holding member 123 as a holding member can be detached from the process cartridge main body, the space holding member 123 need not always be capable of being detached. It is also possible to construct the holding member as a portion of the process cartridge main body. For example, let it be assumed that there is such a process cartridge main body as shown in FIG. 17 wherein the photosensitive drum unit 6 and the developing unit 4 are provided for pivotal movement about a coupling portion 49, and the developing roller 40 and the photosensitive drum 1 are brought into contact with each other by a spring 53 which is biasing means. There is conceivable a construction in which a hook 66, which is the holding member constructed as a portion of the process cartridge main body acts on the process cartridge main body (the hook 66 is caught by a projection 67), whereby against the biasing force of the spring, the developing roller and the photosensitive drum are spaced apart from each other. The hook 66 is mounted for rotation about a shaft 66*b*, and is adapted to be unhooked by a force receiving portion 66*a* receiving a force.

Figure 18:
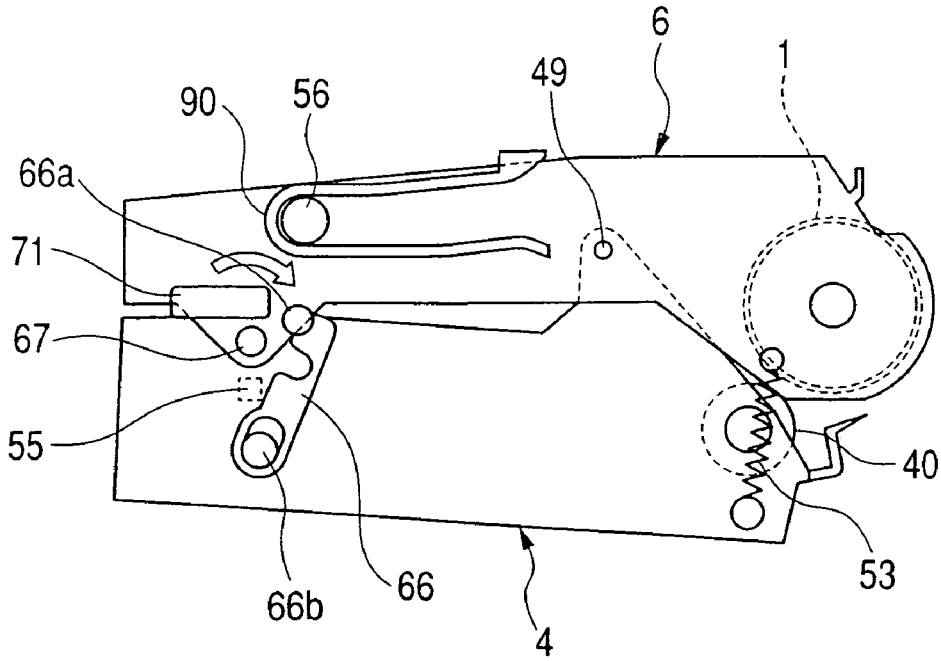
FIG. 18 is a schematic view of the process cartridge when the hook according to the embodiment of the present invention has come not to act on the process cartridge.

When the process cartridge main body is to be mounted on the image forming apparatus main body, a regulating portion 56 provided on the process cartridge main body is mounted along a guide portion 90 provided in the image forming apparatus main body. The design is made such that when the process cartridge main body is mounted on the image forming apparatus main body|, the force receiving portion 66*a* of the hook 66 abuts against a projected portion 71 provided on the image forming apparatus main body and the hook is automatically unhooked, and the developing roller and the photosensitive drum come into contact with each other (FIG. 18). In a case where the holding member is thus constructed as a portion of the process cartridge main body, after the hook has been released and the spacing-apart of the developing roller and the spacing-apart of the charging roller have been released, the developing spacing-apart member remains coupled to the process cartridge main body and therefore, the step of throwing away the developing spacing-apart member after the user has taken it away becomes unnecessary. If the design is made such that when this hook 66 is acting on the process cartridge, the hook 66 covers and hides the memory unit 55 provided on the process cartridge main body, the protection of the holding member and the memory unit can be effected by a single member.

The present invention is not restricted to the above-described embodiments. Other forms and disposition or the like of constituent factors than the embodiments are also possible, but they are confined within the effective scope of the present invention.

This application claims priorities from Japanese Patent Application No. 2003-284839 filed Aug. 1, 2003 and Japanese Patent Application No. 2003-397201 filed Nov. 27, 2003, which are hereby incorporated by reference herein.

What is claimed is:

1. A holding member provided on a process cartridge main body configured and positioned to hold an image bearing member and a process device in one of a spaced-apart state and a pressure released state when said holding member acts on the process cartridge main body, said holding member comprising:

a portion configured and positioned to cover and hide a storing medium provided on the process cartridge main body when said holding member is acting on a process cartridge, the process cartridge main body having: the image bearing member, the process device configured to act on the image bearing member, and the storing medium provided with a communication device configured to communicate with an image forming apparatus main body, wherein the process cartridge main body is detachably mountable on the image forming apparatus main body, wherein the image bearing member and the process device are in contact with each other in a pressure state when said holding member does not act on the process cartridge main body, and wherein the contact pressure of the pressure released state in which the process device and the image bearing member are in contact with each other is smaller than that of the pressure state; and a portion configured and positioned to cover and hide the communication device of the storing medium provided in the process cartridge main body when said holding member is acting on the process cartridge, wherein said portion configured and positioned to cover and hide the storing medium and said portion configured and positioned to cover and hide the communication device of the storing medium neither cover nor hide the communication device and storing medium when said holding member does not act on the process cartridge main body.

2. A holding member according to claim 1, wherein the process device is a charger configured and positioned to contact the image bearing member to charge the image bearing member.

3. A holding member according to claim 1, wherein the process device is a developer carrying member configured and positioned to contact the image bearing member to visualize an electrostatic latent image formed on the image bearing member by use of developer.

4. A holding member according to claim 1, wherein the process cartridge main body has an electrical contact portion configured and positioned to effect power supply from the image forming apparatus main body into the process cartridge main body, and said holding member has a portion configured and positioned to cover and hide the electrical contact portion provided in the process cartridge main body from the outside of the process cartridge main body when said holding member acts on the process cartridge main body and holds the image bearing member and the process device in one of the spaced-apart state and the pressure released state.

5. A holding member according to claim 1, wherein the process cartridge main body has a protecting device configured and positioned to protect the image bearing member, wherein the protecting device is made movable between a position for covering a portion of the image bearing member and a position for exposing a portion of the image bearing member, and said holding member, in a state in which said holding member has acted on the process cartridge main body, has a shape for fixing the protecting device at a position for protecting an exposed surface of the image bearing member.

6. A holding member according to claim 1, wherein the process cartridge main body has a developer container configured to contain a developer therein, and a seal removably attached to an opening portion of the developer container, and sealing the opening portion of the developer container when not used to thereby prevent the developer from leaking out, and wherein one end of the seal is fixed to a portion of said holding member, and said holding member can be moved to remove the seal.

7. A holding member according to claim 1, wherein said holding member is detachably mountable on the process cartridge main body, and wherein the state in which said holding member acts on the process cartridge main body is a state in which said holding member is mounted on said process cartridge main body, and a state in which said holding member is not acting on the process cartridge main body is a state in which said holding member has been detached from the process cartridge main body.

8. A process cartridge detachably mountable on an image forming apparatus main body, said process cartridge comprising:

a process cartridge main body including:

an image bearing member;

a process device configured and positioned to move toward and away from said image bearing member and configured and positioned to act on said image bearing member; and a storing medium provided with a communication device configured and positioned to communicate with the image forming apparatus main body; and a holding member configured and positioned to act on said process cartridge main body to hold said image bearing member and said process device in one of a spaced-apart state and a pressure released state, wherein when said holding member does not act on said process cartridge main body, said image bearing member and said process device are in contact with each other in a pressure state, and when said holding member acts on said process cartridge main body, said image bearing member and said process device are held in one of the spaced-apart state and the pressure released state, wherein the contact pressure of the pressure released state in which said process device and said image bearing member are in contact with each other is smaller than that of the pressure state, and wherein said holding member has a portion configured and positioned to cover and hide said storing medium provided on said process cartridge, and a portion configured and positioned to cover and hide the communication device of said storing medium provided on said process cartridge main body when said holding member acts on said process cartridge main body, and when said holding member does not act on said process cartridge main body, said portion configured and positioned to cover and hide said storing medium and said portion configured and positioned to cover and hide said communication device of said storing medium neither cover nor hide said storing medium and said communication device of said storing medium.

9. A process cartridge according to claim 8, wherein said process device is a charger configured and positioned to contact said image bearing member to charge said image bearing member.

10. A process cartridge according to claim 9, wherein said charger is movable in a direction toward and away from said image bearing member, and when said holding member acts on said process cartridge main body, said holding member acts on a support and holds said charger in one of the spaced-apart state and the pressure released state, and said support does not contact with said image bearing member, but supports said charger.

11. A process cartridge according to claim 10, wherein said support has a hole portion, said holding member has a bar-shaped portion formed with an inclination at its tip end, and said holding member inserts said bar-shaped portion into said hole portion to act on said support, and hold said image bearing member and said charger in one of the spaced-apart state and the pressure released state.

12. A process cartridge according to claim 11, wherein said holding member is movable substantially perpendicularly to a direction toward and away from said image bearing member in which said charger is movable.

13. A process cartridge according to claim 10, wherein said process device also comprises a developer carrying member configured and positioned to contact said image bearing member to visualize an electrostatic latent image formed on said image bearing member by use of developer.

14. A process cartridge according to claim 13, wherein said process cartridge main body has a first frame member configured and positioned to hold said image bearing member, a second frame member configured and positioned to hold said developer carrying member, said second frame and said first frame being mutually rockable in a direction in which said image bearing member and said developer carrying member are moved toward and away from each other, and a biasing device configured and positioned to bias said first frame member and said second frame member in a direction in which said image bearing member and said developer carrying member contact each other, and wherein said holding member acts on said process cartridge main body and holds said image bearing member and said developer carrying member in a spaced-apart state.

15. A process cartridge according to claim 10, wherein said process cartridge main body has an electrical contact portion configured and positioned to effect power supply from said image forming apparatus main body into said process cartridge main body, and said holding member has a portion configured and positioned to cover and hide said electrical contact portion in a state in which said holding member has acted on said process cartridge main body.

16. A process cartridge according to claim 10, wherein said process cartridge main body has a protecting device configured and positioned to protect said image bearing member, said protecting device being constructed for movement between a position for covering a portion of said image bearing member and a position for exposing a portion of said image bearing member, and said holding member, in a state in which said holding member has acted on said process cartridge main body, fixes said protecting device at a position for protecting an exposed surface of said image bearing member.

17. A process cartridge according to claim 10, wherein said process cartridge main body has a developer container configured to contain a developer, and a seal removably attached to an opening portion of said developer container and configured and positioned to prevent the developer from leaking out from the opening portion of said developer container when not used, and wherein one end of said seal is fixed to a portion of said holding member, and said holding member can be moved to remove said seal.

18. A process cartridge according to claim 17, wherein said holding member to which one end of said seal is fixed is moved from a state in which said holding member has acted on said process cartridge main body to a first position, whereby said holding member comes not to act on said process cartridge main body, and said image bearing member and said process device come into the pressure state, and at this time, said seal remains sealed, and said holding member to which one end of said seal is fixed is further moved from the first position to a second position to remove said seal.

19. A process cartridge detachably mountable on an image forming apparatus main body, said process cartridge comprising:

a process cartridge main body including:

an image bearing member;

a charger configured and positioned to contact said image bearing member in a pressure state to charge said image bearing member; and a support configured and positioned not to contact said image bearing member, but supporting said charger; and a holding member provided on said process cartridge main body configured and positioned to hold said image bearing member and said charger in one of a spaced-apart state and a pressure released state, wherein when said holding member does not act on said process cartridge main body, said image bearing member and said charger are in said pressure state, and when said holding member acts on said process cartridge main body, said holding member acts on said support to hold said image bearing member and said charger in one of the spaced-apart state and the pressure released state, and wherein the contact pressure of the pressure released state in which said charger and said image bearing member are in contact with each other is smaller than that of the pressure state.

20. A process cartridge according to claim 19, wherein said support has a hole portion, said holding member has a bar-shaped portion formed with an inclination at its tip end, and said holding member inserts said bar-shaped portion into said hole portion to act on said support, and brings said charger and said image bearing member into one of the pressure state, the spaced-apart state and the pressure released state.

21. A process cartridge according to claim 19, wherein said holding member is movable substantially perpendicularly to a direction in which said charger is movable toward and away from said image bearing member.

22. A process cartridge according to claim 19, wherein a first frame member is configured and positioned to rotatably hold said image bearing member and to hold said charger, wherein a second frame member is rockable relative to said first frame member and provided with a developer carrying member, wherein said developer carrying member carries thereon a developer for developing an electrostatic latent image formed on a surface of said image bearing member, wherein said process cartridge main body has a biasing device configured and positioned to bias said first frame member and said second frame member to bring said developer carrying member and said image bearing member into contact with each other, and said holding member can act on said process cartridge main body to move said first frame member and said second frame member against a biasing force of said biasing device, and hold said developer carrying member and said image bearing member from the pressure state into the spaced-apart state.

23. A process cartridge according to claim 22, wherein said process cartridge main body has a storing medium provided with a communication device configured and positioned to communicate with said image forming apparatus main body, and said holding member has a portion configured and positioned to cover and hide the storing medium provided in said process cartridge main body, and a portion configured and positioned to cover and hide said communication device of said storing medium when said holding member acts on said process cartridge main body.

24. A process cartridge according to claim 19, wherein said process cartridge main body has a developer container configured to contain a developer, and a seal removably attached to an opening portion of said developer container configured and positioned to prevent the developer from leaking out from the opening portion of said developer container, wherein one end of said seal is fixed to a portion of said holding member, and said holding member can be moved to remove the seal.

25. A process cartridge according to claim 24, wherein said holding member to which one end of said seal is fixed is moved from a state in which said holding member has acted on said process cartridge main body to a first position, whereby said holding member comes not to act on said process cartridge main body, and said image bearing member and said charger, and said image bearing member and said developer carrying member come into contact with each other, and at this time, said seal remains sealed, and said holding member to which one end of said seal is fixed is further moved from the first position to a second position to remove said seal.

26. A process cartridge detachably mountable on an image forming apparatus main body, said process cartridge comprising:

a process cartridge main body including:

an image bearing member;

a first frame member configured and positioned to hold said image bearing member;

a second frame member rockable relative to said first frame member, said second frame member having a developer container configured to contain a developer for developing an electrostatic latent image formed on a surface of said image bearing member, a seal removably attached to an opening portion of said developer container configured and positioned to prevent the developer from leaking out from the opening portion of said developer container when not used, and a developer carrying member carrying said developer thereon; and a biasing device configured and positioned to bias said first frame member and said second frame member to bring said developer carrying member and said image bearing member into contact with each other; and a holding member configured and positioned to act on said process cartridge main body to move said first frame member and said second frame member against a biasing force of said biasing device, and space said developer carrying member and said image bearing member apart from each other and hold said developer carrying member and said image bearing member in the spaced-apart state, wherein said holding member has one end of said seal fixed thereto, and said holding member is moved from a state in which said holding member is acting on said process cartridge main body to a first position, whereby said holding member comes not to act on said process cartridge main body, and said developer carrying member and said image bearing member come into contact with each other, and at this time, said seal continues to seal said opening portion, and said holding member is further moved from the first position to a second position to remove said seal.

27. A process cartridge according to any one of claims 8, 19 and 26, wherein said holding member is detachably mountable on said process cartridge main body, wherein a state in which said holding member has acted on said process cartridge main body is a state in which said holding member has been mounted on said process cartridge main body, and wherein a state in which said holding member is not acting on said process cartridge main body is a state in which said holding member has been detached from said process cartridge main body.

28. A process cartridge according to any one of claims 8, 16, 19 and 26, wherein said image bearing member is an electrophotographic photosensitive member.

* * * * *

UNITED STATES PATENT AND TRADEMARK OFFICE

CERTIFICATE OF CORRECTION

PATENT NO. : 7,072,603 B2
APPLICATION NO. : 10/902250
DATED : July 4, 2006
INVENTOR(S) : Masatomo Tsuzuki et al.

It is certified that error appears in the above-identified patent and that said Letters Patent is hereby corrected as shown below:

COLUMN 16:
Line 48, “mounted-on” should read --mounted on--.

COLUMN 18:
Line 23, “body|” should read --body--.

Signed and Sealed this

Thirty-first Day of July, 2007

JON W. DUDAS
*Director of the United States Patent and Trademark Office*